US012747928B2

(12) United States Patent
Hansen et al.

(10) Patent No.: US 12,747,928 B2
(45) Date of Patent: Sep. 29, 2026

(54) BOW WITH VARIABLE DRAW WEIGHTS

(71) Applicant: Precision Shooting Equipment, LLC., Tucson, AZ (US)

(72) Inventors: Kevin L. Hansen, Jefferson City, MT (US); David Alan McNealy, Marana, AZ (US)

(73) Assignee: Precision Shooting Equipment, LLC., Tucson, AZ (US)

( * ) Notice: Subject to any disclaimer, the term of this patent is extended or adjusted under 35 U.S.C. 154(b) by 63 days.

(21) Appl. No.: 18/904,456

(22) Filed: Oct. 2, 2024

(65) Prior Publication Data

US 2026/0092756 A1 Apr. 2, 2026

(51) Int. Cl.
*F41B 5/10* (2006.01)

(52) U.S. Cl.
CPC ..... *F41B 5/10* (2013.01)

(58) Field of Classification Search
CPC .... F41B 5/10; F41B 5/105; F41B 5/14; F41B 5/1403
See application file for complete search history.

(56) References Cited

U.S. PATENT DOCUMENTS

| | | | | |
|---|---|---|---|---|
| 5,280,779 | A * | 1/1994 | Smith | F41B 5/0026 124/88 |
| 5,720,267 | A * | 2/1998 | Walk | F41B 5/10 124/23.1 |
| 6,024,076 | A * | 2/2000 | Laborde | F41B 5/0026 124/23.1 |
| 7,784,452 | B1 * | 8/2010 | Kronengold | F41B 5/10 124/23.1 |
| 8,347,869 | B2 * | 1/2013 | Sims | F41B 5/14 124/23.1 |
| 8,453,635 | B1 * | 6/2013 | McPherson | F41B 5/10 124/25 |
| 8,844,508 | B2 | 9/2014 | Sims et al. | |
| 9,581,406 | B1 * | 2/2017 | Nevels | F41B 5/0026 |
| 11,828,566 | B1 * | 11/2023 | Hansen | F41B 5/105 |
| 2012/0192843 | A1 * | 8/2012 | Batdorf | F41B 5/10 124/25.6 |
| 2013/0312724 | A1 * | 11/2013 | Hudkins | F41B 5/123 124/25 |
| 2022/0074701 | A1 * | 3/2022 | Sidebottom | F41B 5/1403 |
| 2025/0244099 | A1 * | 7/2025 | Blosser | F41B 5/1403 |

* cited by examiner

*Primary Examiner* — Joshua E Freeman
(74) *Attorney, Agent, or Firm* — Merchant & Gould P.C.

(57) ABSTRACT

The present disclosure relates to a compound bow having limbs attached to a riser by limb attachment members. The limb attachment members can be mounted to the riser at different draw weight positions to alter a draw weight of the bow. Certain examples allow different ranges of draw weights for each draw weight position.

30 Claims, 20 Drawing Sheets

BOW WITH VARIABLE DRAW WEIGHTS

TECHNICAL FIELD

The present disclosure relates generally to archery equipment. More particularly, the present disclosure relates to compound bows.

BACKGROUND

A typical compound bow includes a riser (i.e., a handle) and resilient limbs attached to opposite ends of the riser by pockets. Cams are mounted at free ends of the limbs and tensioning cables as well as a bow string are routed between the cams. Limb bolts are used to pivot the pockets relative to the riser to tension the tensioning cables and to set a string draw weight of the bow. Example patents disclosing bows having adjustable draw weights include U.S. Pat. Nos. 11,828,566; 7,784,452 and 8,844,508.

SUMMARY

One aspect of the present disclosure relates to a bow including a riser having an upper end, a lower end, a front side, a rear side, a left side and a right side. The bow also includes upper and lower limbs respectively secured to the upper and lower ends of the riser. The bow further includes cams for engaging a bow string, the cams being mounted to the upper and lower limbs. The bow also includes limb attachment members for attaching the upper and lower limbs to the riser. The limb attachment members each are mountable to the riser in a first draw weight position and a second draw weight position. The limb attachment members are pivoted and translated relative to the riser when moved between the first and second draw weight positions. The bow has a larger draw weight when the limb attachment members are in the first draw weight position as compared to when the limb attachment members are in the second draw weight position. By coordinating the pivotal and translational movement between positions, the draw weight can be adjusted while minimizing a change in a draw length of the bow.

Another aspect of the present disclosure relates to a compound bow having limbs attached to a riser by pivotal limb pockets. The pivotal limp pockets can be pivotally adjusted about pivot axes relative to the riser by limb bolts to adjust a draw weight of the bow. The bow is configured such that the pivot axes of the pivotal limb pockets can be set at different positions relative to the riser to allow the limb bolts to provide different ranges of draw weights. In certain examples, the different positions of the pivot axes are designed to minimize a change in the draw length of the bow.

A further aspect of the present disclosure relates to a bow including a riser having an upper end, a lower end, a front side, a rear side, a left side and a right side. The bow also includes upper and lower limbs respectively secured to the upper and lower ends of the riser.

The bow further includes cams for engaging a bow string, the cams being mounted to the upper and lower limbs. The bow also includes pivotal limb attachment members for attaching the upper and lower limbs to the riser. The pivotal limb attachment members are pivotally moveable relative to the riser about laterally oriented pivot axes. The pivot axes are each positionable at a first pivot axis location relative to the riser and a second pivot axis location relative to the riser.

The first and second pivot axis locations for each pivot axis are spaced-apart from each other.

The bow includes limb bolts for setting pivotal positions of the limb attachment members relative to the riser about the pivot axes. When the pivot axes are at the first pivot axis locations the limb bolts can be used to adjust a draw weight of the bow across a first range of draw weights. When the pivot axes are at the second pivot axis locations the limb bolts can be used to adjust the draw weight of the bow across a second range of draw weights different than the first range of draw weights.

Another aspect of the present disclosure relates to a bow including a riser having an upper end, a lower end, a front side, rear side, a left side and a right side. The bow also includes upper and lower limbs having base ends and free ends. The base ends of the upper limbs attach to the upper end of the riser and the base ends of the lower limbs attach to the lower end of the riser. The bow further includes cams for engaging a bow string of the bow. The cams are mounted at the free ends of the upper and lower limbs. Limb pockets mount to the upper and lower ends the riser for attaching the base ends of the upper and lower limbs to the riser. Laterally oriented pivot axles are provided for allowing pivotal movement of the limb pockets relative to the riser to adjust a draw weight of the bow. Limb bolts are provided for setting pivotal positions of the limb pockets relative to the riser about pivot axes defined by the pivot axles to set a draw weight of the bow. The upper and lower ends of the riser define receivers. Draw weight range adjustment members mount in the receivers. The draw weight range adjustment members define pivot axle openings for receiving the pivot axles. The draw weight range adjustment members are mountable in first and second orientations within the receivers. The pivot axes are each at a first position relative to the riser when the draw weight range adjustment members are each mounted in the first orientation within the receivers. The pivot axes are each at second position relative to the riser when the draw weight range adjustment members are each mounted in the second orientation within the receivers. The first and second positions are offset from each other such that when the draw weight range adjustment members are in the first orientation the limb bolts can be used to adjust the draw weight across a first range of draw weights, and when the draw weight range adjustment members are in the second orientation the limb bolts can be used to adjust the draw weight across a second range of draw weights different than the first range of draw weights.

A further aspect of the present disclosure relates to a bow including a riser having an upper end, a lower end, a front side, a rear side, a left side and a right side. Upper and lower limbs are respectively secured to the upper and lower ends of the riser. Cams for engaging a bow string are mounted to the upper and lower limbs. Pivotal limb attachment members attach the upper and lower limbs to the riser. Laterally oriented pivot axles allow for pivotal movement of the pivotal limb attachment members relative to the riser to adjust a draw weight of the bow. Limb bolts are provided for setting pivotal positions of the pivotal limb attachment members relative to the riser about pivot axes defined by the pivot axles to set a draw weight of the bow. The upper and lower ends of the riser define receivers. The bow also includes a draw weight range adjustment system including draw weight range adjustment members that mount in the receivers. The draw weight range adjustment members define pivot axle openings for receiving the pivot axles. The draw weight range adjustment members are configured to allow a position of each pivot axes to be moved relative to the riser between at least a first position and a second position. When the pivot axes are each in the first position the limb bolts can be used to adjust the draw weight across a first range of draw weights and when the pivot axes are each in the second position the limb bolts can be used to adjust the draw weight across a second range of draw weights different than the first range of draw weights.

DETAILED DESCRIPTION

The present disclosure relates to a compound bow having limb attachment members (e.g., limb pockets) that can be set at different draw weight positions relative to a riser to modify the draw weight characteristics of the bow. In certain examples, the draw weight characteristics of the bow can be modified without affecting the draw length of the bow or minimizing a change in draw length of the bow. In certain examples, the change in position of the limb attachment members involves both pivotal and translational movement of the limb attachment members with respect to a riser of the bow with the pivotal and translational movement coordinated to modify draw weight while minimizing any changes in draw length.

In certain examples, pivotal limb attachment members (e.g., limb pockets) are provided for attaching upper and lower limbs to a riser. The pivotal limb attachment members are pivotally moveable relative to the riser about laterally oriented pivot axes. The pivot axes are each positionable at a first pivot axis location relative to the riser and a second pivot axis location relative to the riser. The first and second pivot axis locations for each pivot axis are spaced-apart from each other. Limb bolts can be provided for setting pivotal positions of the limb attachment members relative to the riser about the pivot axes. When the pivot axes are at the first pivot axis locations the limb bolts can be used to adjust a draw weight of the bow across a first range of draw weights. When the pivot axes are at the second pivot axis locations the limb bolts can be used to adjust the draw weight of the bow across a second range of draw weights different than the first range of draw weights.

In certain examples, different pivot axis positions for pivotal limb attachment members can be set by draw weight range adjustment members that mount within receivers defined by the riser. The draw weight range adjustment members can define pivot openings for receiving pivot axles about which the pivotal limb attachment members pivot. In one example, the draw weight range adjustment members can be mounted in different orientations within the receivers (e.g., flipped 180 degrees) to change the pivot axis positions. In another example, draw weight range adjustment members can be provided in sets of draw weight adjustment members positionable in the receivers with each set having draw weight range adjustment members with different configurations to provide different pivot opening placement with respect to the riser. The pivotal limb attachment members can be pivotally adjusted about pivot axes relative to the riser by limb bolts to adjust a draw weight of the bow. By setting the pivot axes of the pivotal limb attachment members at different positions relative to the riser, the limb bolts can provide different ranges of draw weights. In certain examples, more than two different pivot axis positions can be provided for each of the pivot axes.

Figure 1:
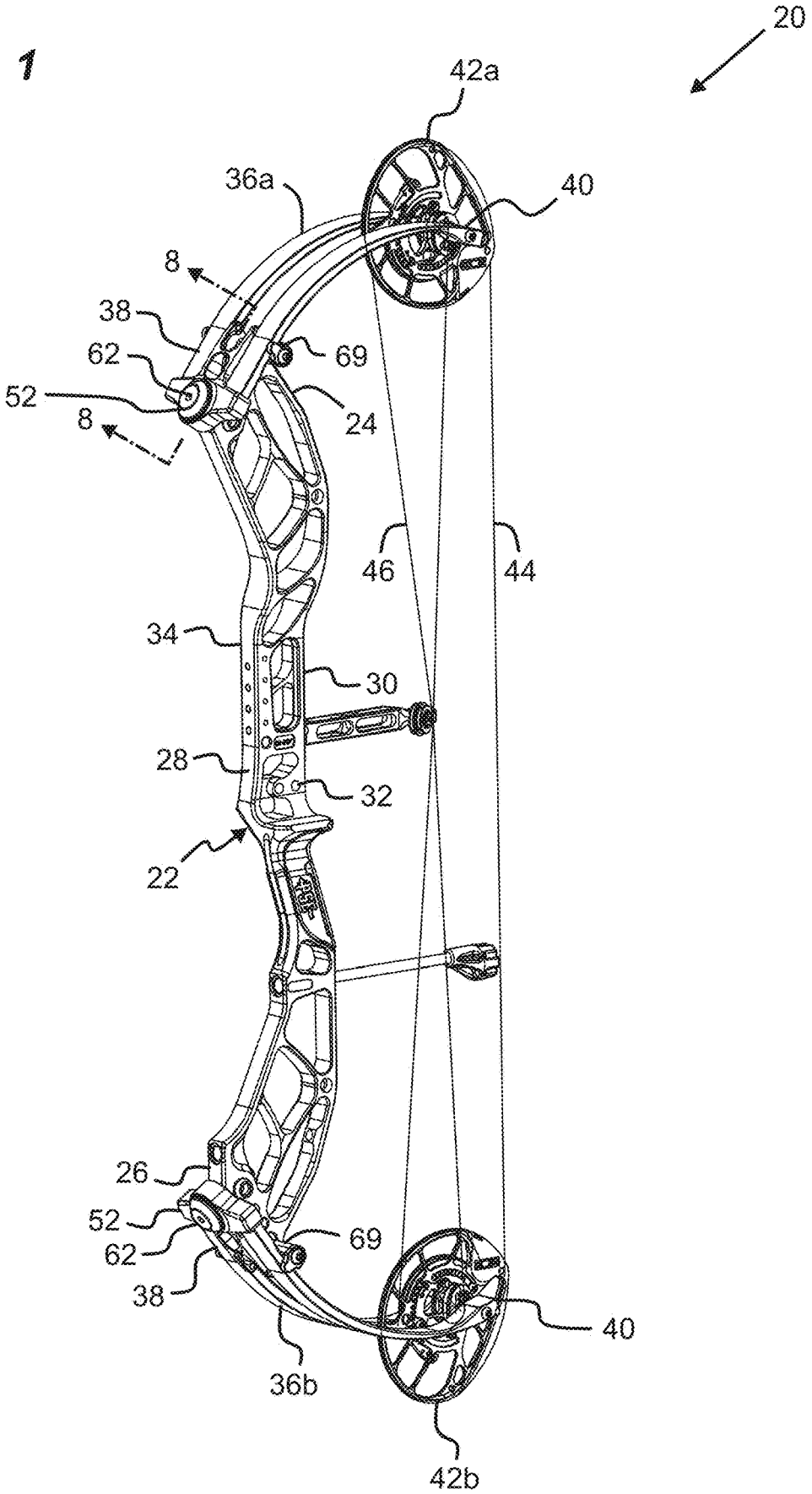
FIG. 1 is a front, left side perspective view of a compound bow in accordance with the principles of the present disclosure.
Figure 2:
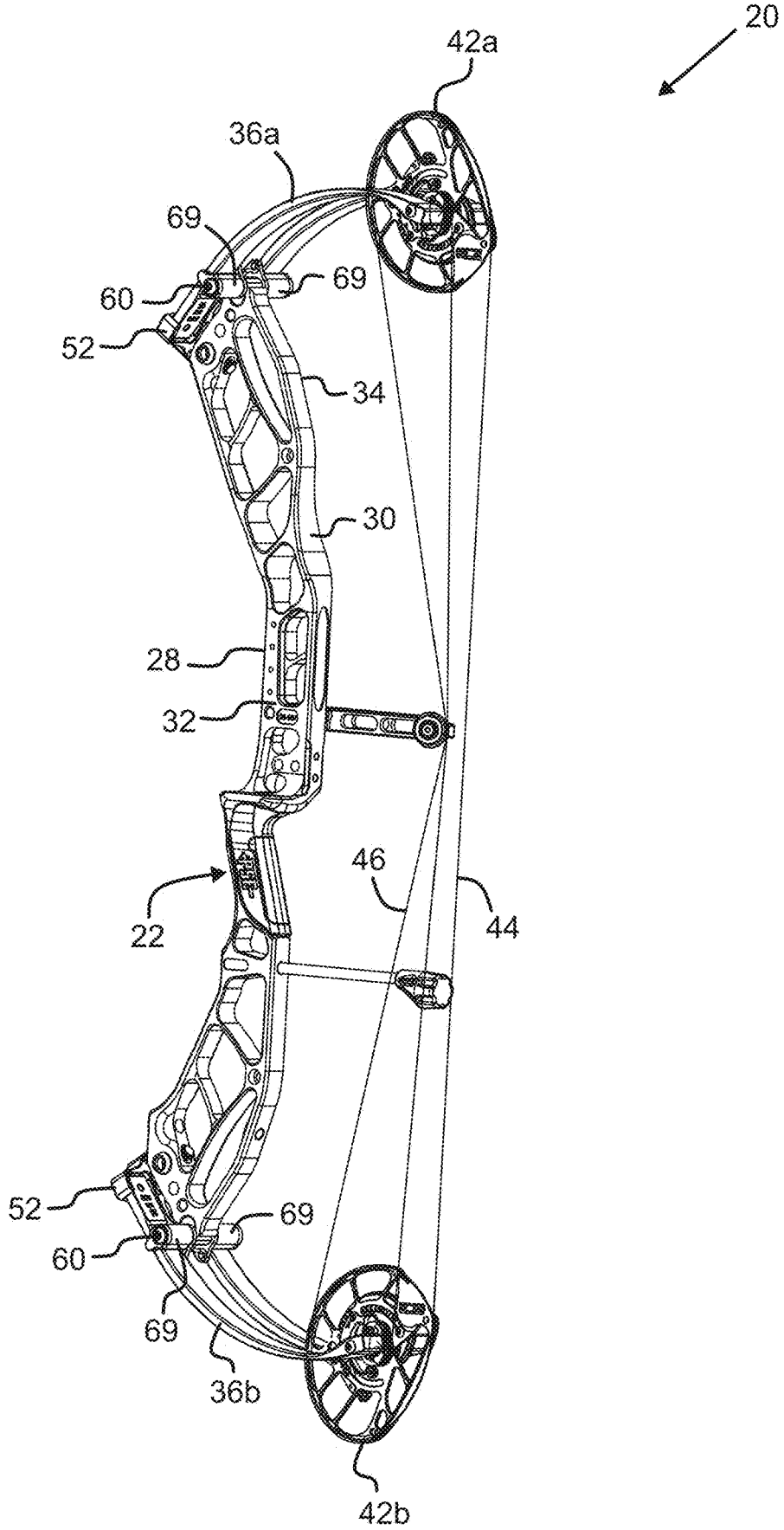
FIG. 2 is a rear, left side perspective view of the compound bow of FIG. 1.
Figure 3:
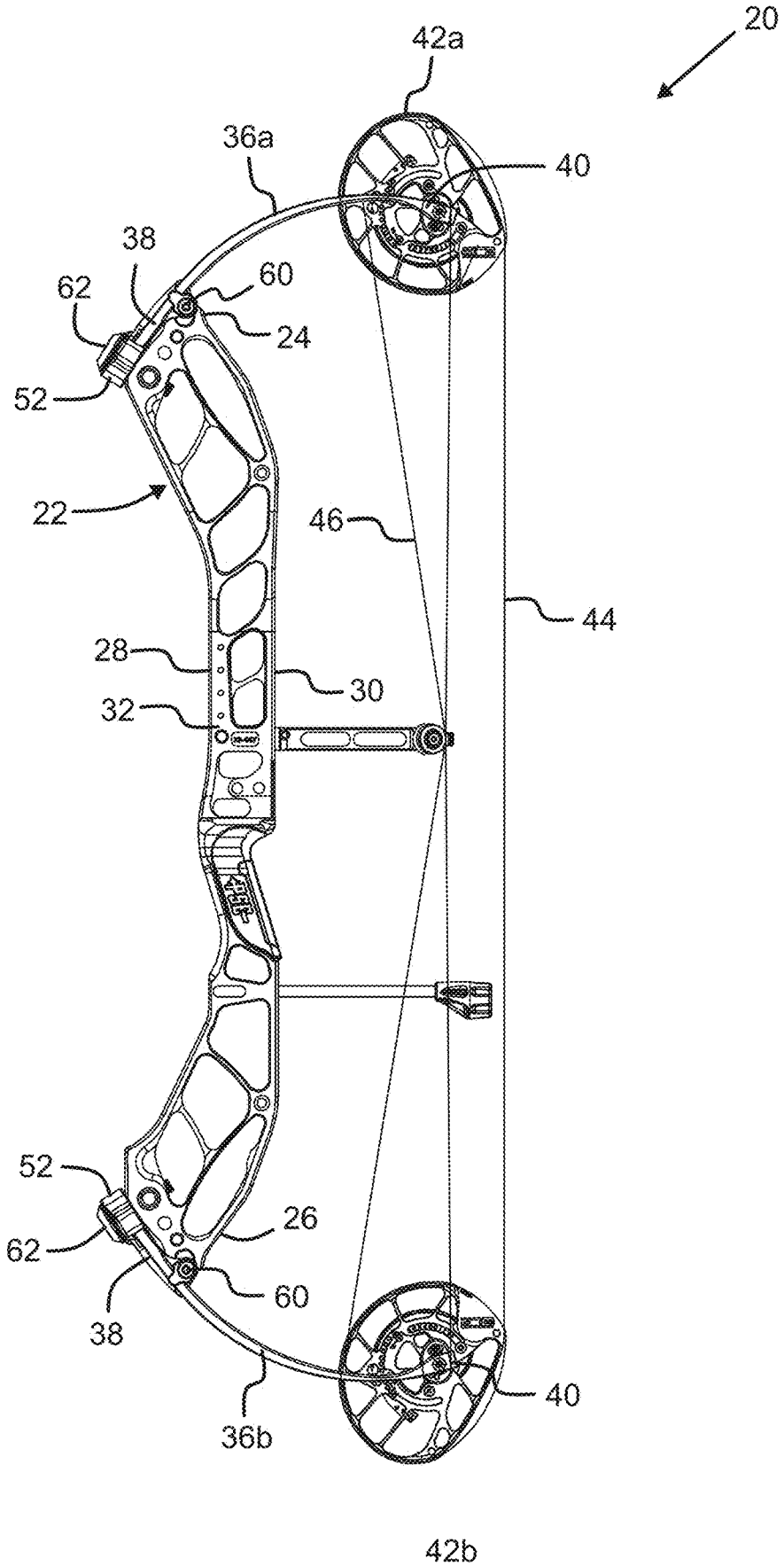
FIG. 3 is a left side view of the compound bow of FIG. 1.

FIGS. 1-3 depict a bow 20 in accordance with the principles of the present disclosure.

The bow 20 includes a riser 22 (i.e., a handle) having an upper end 24, a lower end 26, a front side 28, a rear side 30, a left side 32 and a right side 34. The bow 20 also includes upper and lower limbs 36*a*, 36*b* having base ends 38 and free ends 40. The base ends 38 of the upper limbs 36*a* attach to the upper end 24 of the riser 22 and the base ends 38 of the lower limbs 36*b* attach to the lower end 26 of the riser 22. The bow 20 further includes an upper cam 42*a* supported by the free ends 40 of the upper limbs 36*a* and a lower cam 42*b* supported by the free ends 40 of the lower limbs 36*b*. The upper and lower cams 42*a*, 42*b* are configured to engage a bow string 44 and tensioning cables 46.

The bow 20 further includes pivotal limb attachment members such as pivotal limb pockets 52 that mount to the upper and lower ends 24, 26 of the riser 22 for attaching the base ends 38 of the upper and lower limbs 36*a*, 36*b* to the upper and lower ends 24, 26 of the riser 22. The limb pockets 52 are secured to the riser 22 by laterally oriented pivot axles 60 (see FIGS. 4-6 and 8-10) that allow for pivotal movement of the limb pockets 52 relative to the riser 22 to adjust a draw weight of the bow 20. The pivot axles 60 define pivot axes 59 about which the limb pockets 52 can be pivoted to adjust the draw weight of the bow 20. The bow 20 can further include limb bolts 62 (see FIGS. 8-10) for setting a draw weight of the bow 20 by controlling the pivotal positions of the limb pockets 52 about the pivot axes 59 relative to the riser 22. Turning one of the limb bolts 62 in a first direction about its bolt axis causes the corresponding limb pocket 52 to pivot in a first direction relative to the riser 22 about the corresponding pivot axis 59 to increase flexure of the limbs. Turning one of the limb bolts 62 in a second direction about its bolt axis results in the corresponding limb pocket 52 pivoting relative to the riser 22 in a second direction about the corresponding pivot axis 59 to decrease the flexure of the limbs. The limb bolts 62 can thread within nuts 61 secured within the riser 22. The nuts 61 can pivot about lateral axes 25 to accommodate translational and pivotal movement of the limb pockets 52 relative to the riser 22. The nuts 61 mount with the riser 22 (e.g., in pockets) in alignment with limb bolt openings 101 (see FIG. 10) defined by the riser 22. The limb bolts 62 extend into and at least partially through the limb bolt openings 101 defined by the riser 22. The limb bolt openings 101 can be enlarged with respect to the limb bolts 62 to accommodate translational and pivotal movement of the limb pockets 52 relative to the riser 22.

Figure 11:
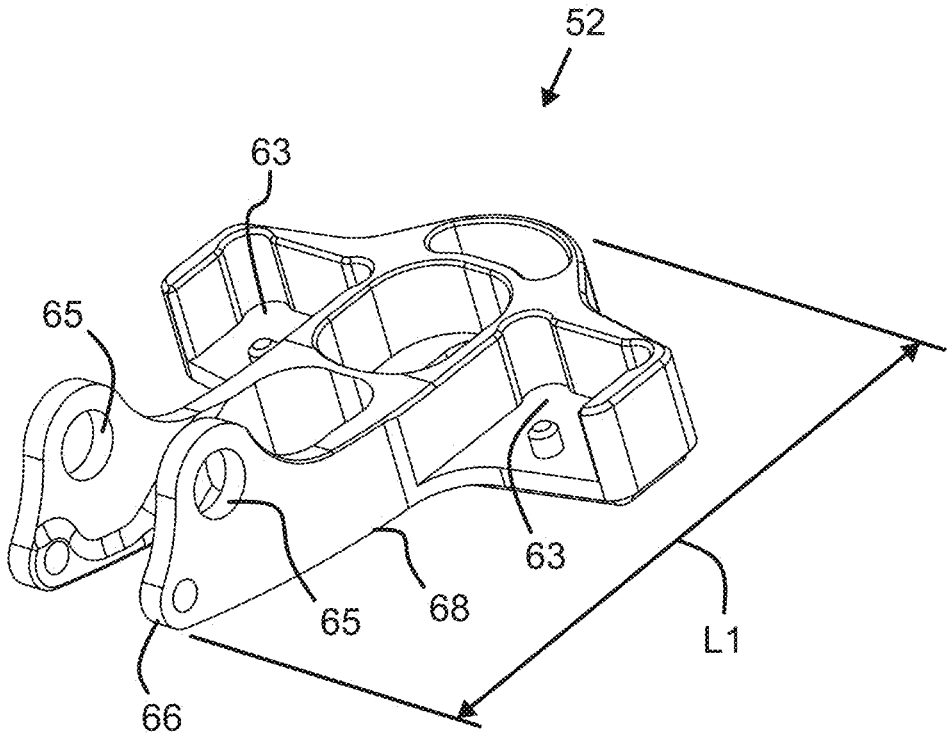
FIG. 11 is a perspective view of one of the limb pockets of the bow of FIG. 1.
Figure 12:
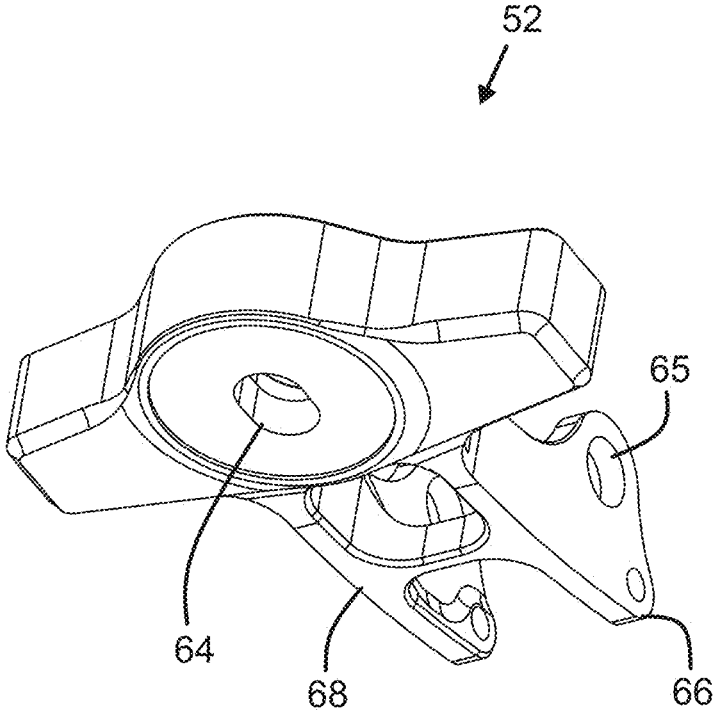
FIG. 12 is another perspective view of the limb pocket of FIG. 11.

Referring to FIGS. 11 and 12, the limb pockets 52 can define receptacles 63 for receiving the base ends of the limbs 36*a*, 36*b*. The limb pockets 52 can also each define a bolt opening 64 through which the corresponding limb bolt 62 extends. The limb pockets 52 can also define openings 65 for receiving the pivot axles 60. For example, an end portion 66 of one of the limb pockets 52 can be configured to straddle the riser 22 (and draw weight adjustment members 72 mounted to the riser) and can define co-axially aligned openings 65. The bolt openings 64 can have depths that extend along bolt axes 67 (see FIG. 8) that are transversely aligned with respect to the pivot axes 59 when the limb pockets 52 are secured to the riser 22. The bolt openings 64 are offset from the openings 65 in an orientation along a length L1 of each limb pocket 52 such that a moment arm 68 is defined by each limb pocket 52 between the pivot axes 59 and the limb bolts 62. Limb supports 69 (see FIG. 6) mount on end portions of the pivot axles 60 that project outwardly from the limb pockets 52 when the pivot axles 60 are installed through the openings 65. The limbs 36*a*, 36*b* are supported on the limb supports 69. The bolt openings 64 can be elongate along the length L1 to accommodate translational and pivotal movement of the limb pockets 52 relative to the riser 22.

Figure 4:
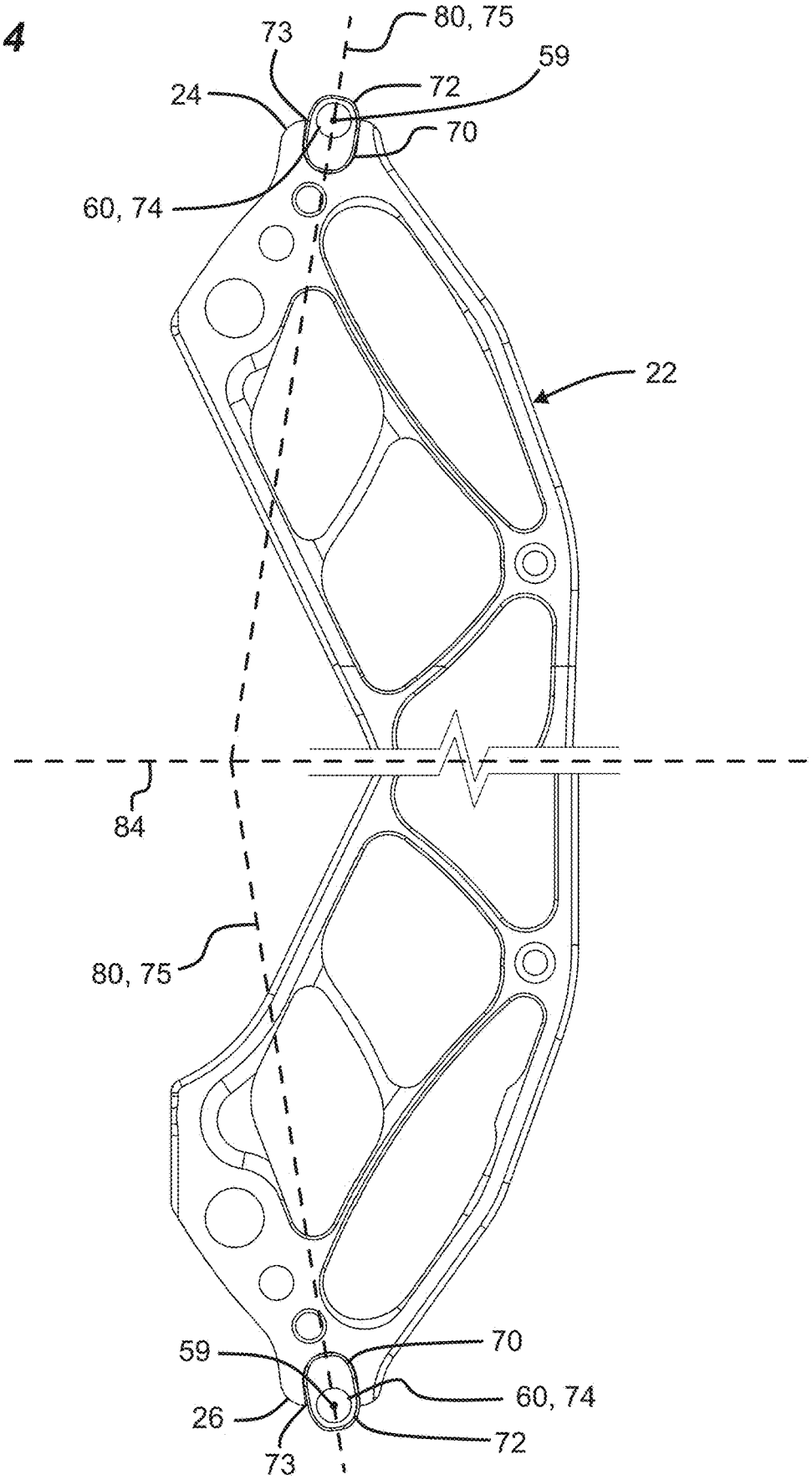
FIG. 4 is a left side fragmentary view showing upper and lower ends of a riser of the bow of FIG. 1 with draw weight adjustment members each mounted in a first orientation within a corresponding receiver of the riser.
Figure 5:
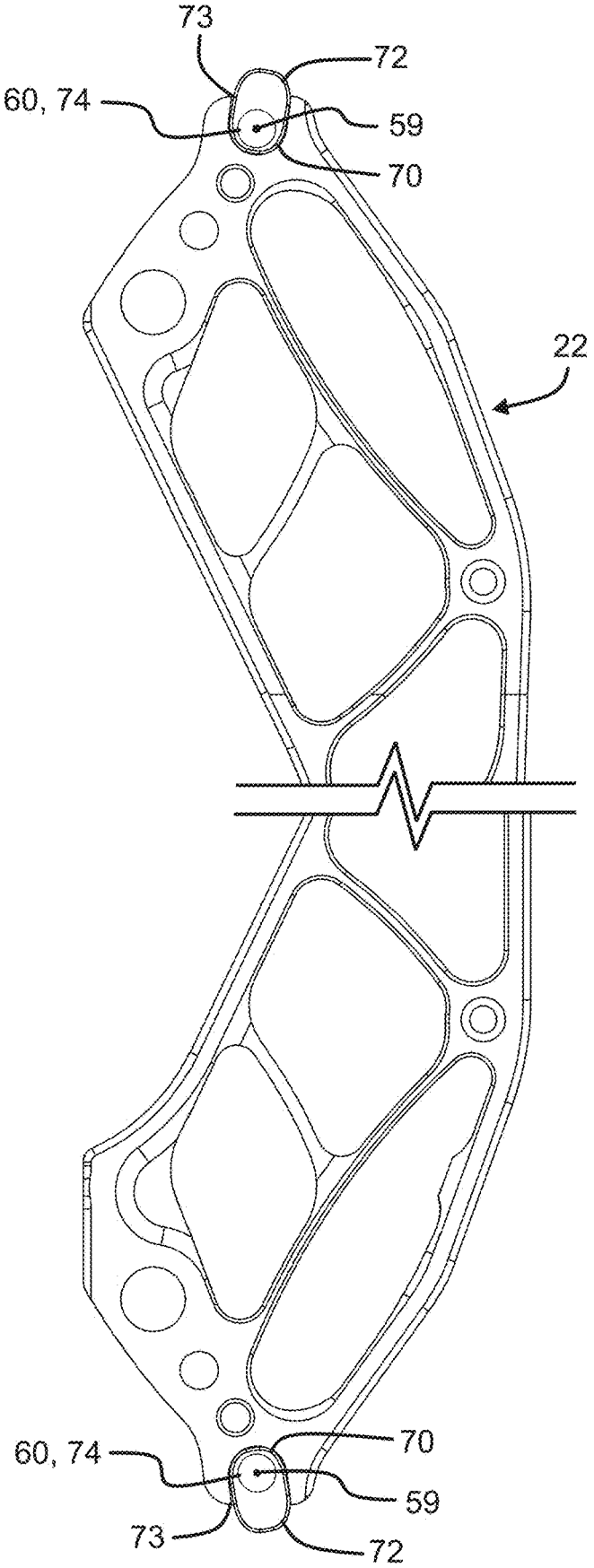
FIG. 5 is a left side fragmentary view showing upper and lower ends of a riser of the bow of FIG. 1 with the draw weight adjustment members each mounted in a second orientation within a corresponding receiver of the riser.
Figure 6:
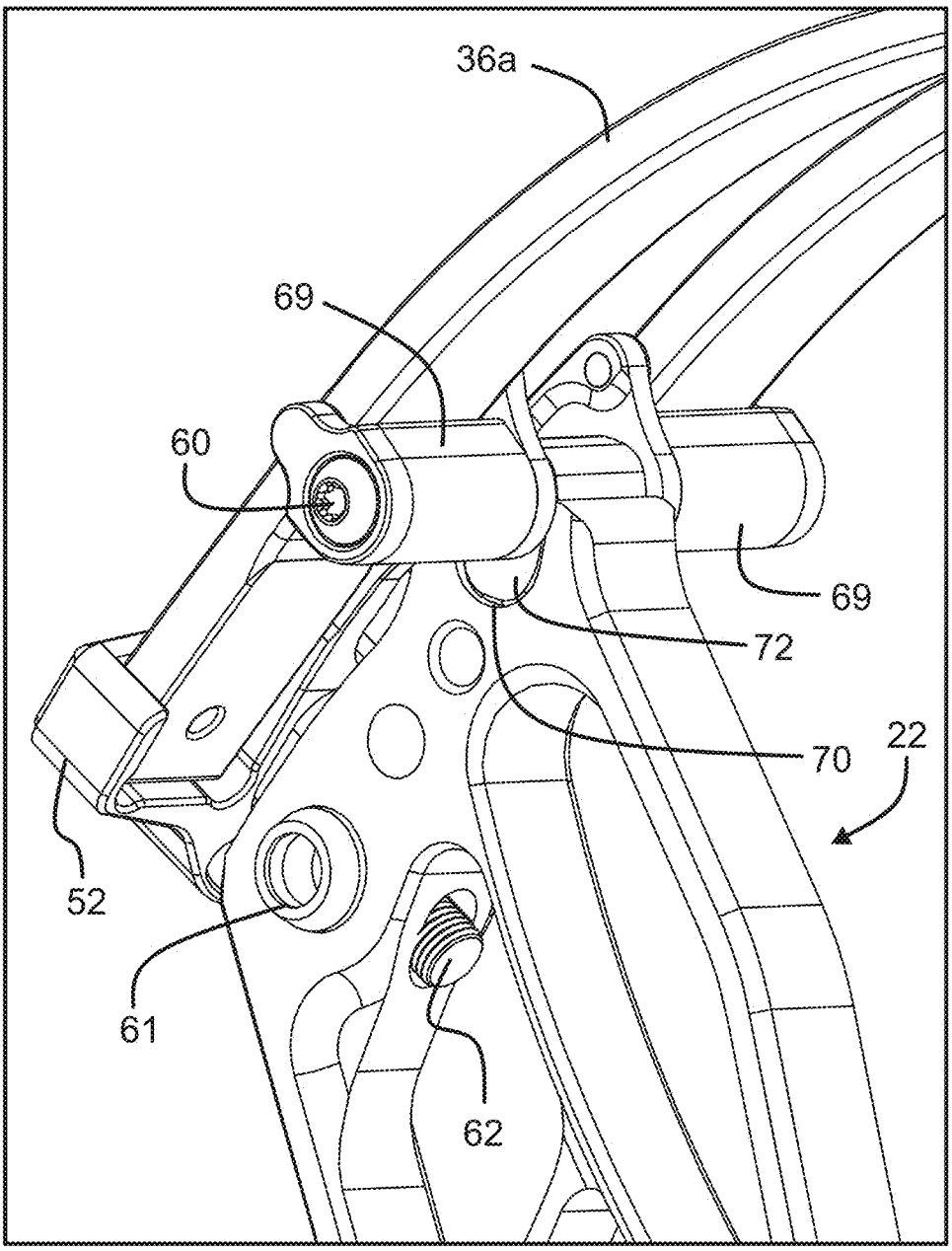
FIG. 6 is an enlarged view showing a limb pocket attaching limbs to the upper end of the riser of the compound bow of FIG. 1.
Figure 7:
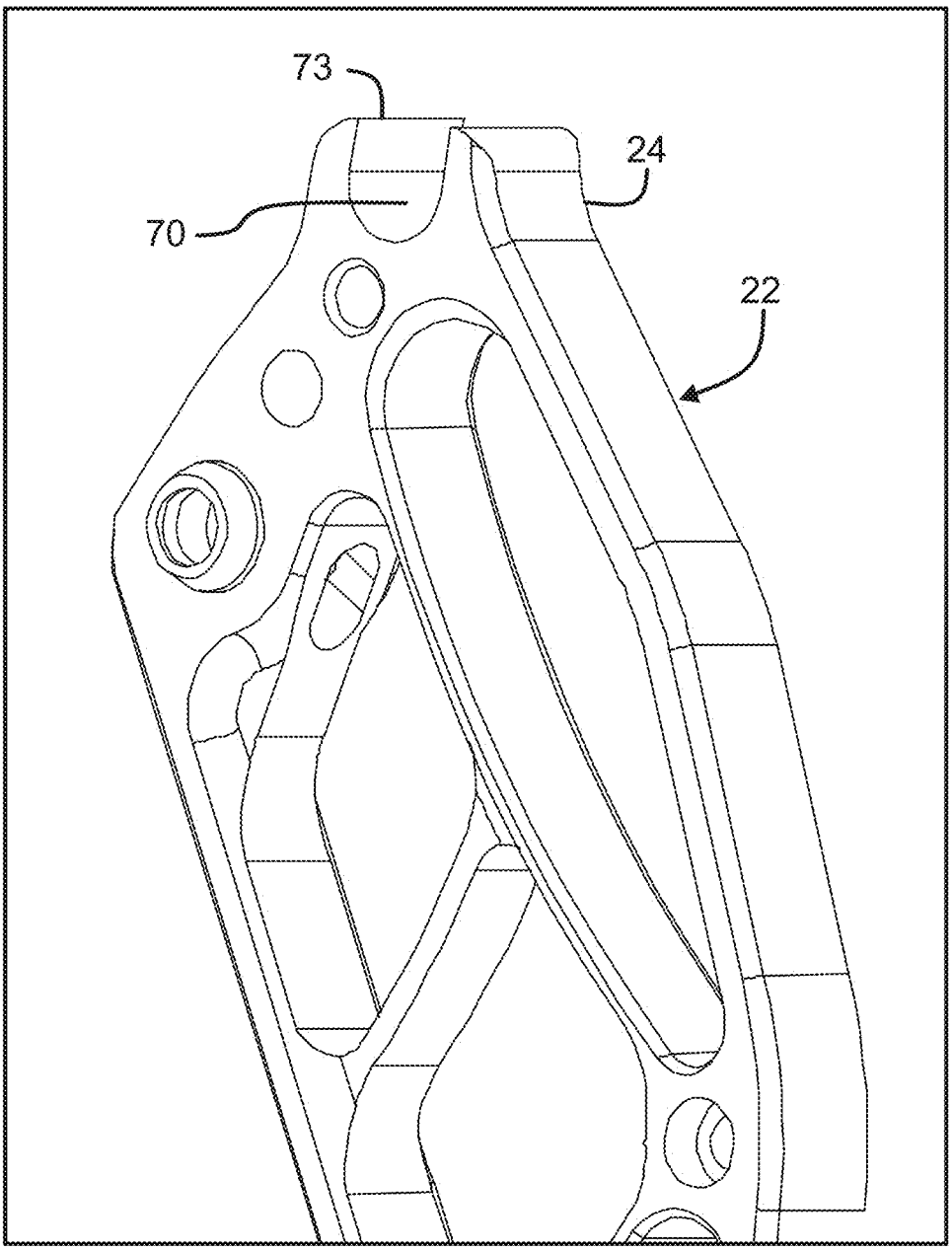
FIG. 7 is a perspective view of the upper end of the riser of the compound bow of FIG. 1.

The upper and lower ends 24, 26 of the riser 22 define receivers 70 (see FIGS. 4, 5 and 7). Draw weight range adjustment members 72 (see FIGS. 4, 5 and 8-10) removably mount in the receivers 70. The draw weight range adjustment members 72 define pivot axle openings 74 that co-axially align with and are positioned between the openings 65 defined by the limb pockets 52 when the bow is assembled. The openings 65 as well as the pivot axle openings 74 are configured for receiving the pivot axles 60 such that the pivot axes 59 of the pivot axles 60 pass axially through and are centered with respect to the openings 65 and the pivot axle openings 74. The draw weight range adjustment members 72 are mountable in a first orientation (e.g., see FIG. 4) within the receivers 70 and a second orientation (see FIG. 5) within the receivers 70. The pivot axes 59 are each at a first position relative to the riser 22 when the draw weight range adjustment members 72 are each mounted in the first orientation within the receivers 70; and are each at a second position relative to the riser 22 when the draw weight range adjustment members 72 are each mounted in the second orientation within the receivers 70. As depicted, the first position is outwardly offset from the second position with respect to the riser 22. The offset between the first and second positions of the pivot axes 59 results in a change in flexure of the limbs 36*a*, 36*b* and a change in draw weight of the bow for given pivotal positions of each of the limb pockets 52 which are set by the limb bolts 62. Thus, when the draw weight range adjustment members 72 are in the first orientation the limb bolts 62 can be used to adjust the draw weight across a first range of draw weights, and when the draw weight range adjustment members 72 are in the second orientation the limb bolts 62 can be used to adjust the draw weight across a second range of draw weights different than the first range of draw weights. The range of draw weights is defined by the range of pivotal movement of the limb pockets 52 about the axes 59. In certain examples, the first and second ranges of draw weights partially overlap. It will be appreciated that the first position of FIG. 4 corresponds to a higher draw weight than the second position of FIG. 5. The first position can refer to a first position of the pivot axes 59 (e.g., a first pivot axis position), a first position of the pivot axles 60 (e.g., a first pivot axle position) or a first position of the pivot axle openings 74 (e.g., a first pivot axle opening position). The second position can refer to a second position of the pivot axes 59 (e.g., a second pivot axis position), a second position of the pivot axles 60 (e.g., a second pivot axle position) or a second position of the pivot axle openings 74 (e.g., a second pivot axle opening position).

In the depicted example, the draw weight adjustment members 72 are configured to be mounted in only two different orientations within the receivers 70 with each orientation corresponding to a different pivot axis position. In other examples, the draw weight adjustment members and the receivers can be configured such that the draw weight adjustment members can be mounted in three or more different orientations with each orientation corresponding to a different pivot axis position. In other examples, sets of draw weight members can be provided for each of the receivers 70. The draw weight members of each set can have different axle opening placements and can be interchanged within the receivers to adjust the pivot axis positions of the limb pockets 52. Thus, different ones of the draw weight adjustment members of each set can be selected to provide different positions of the pivot axes relative the riser.

As depicted, placing the draw weight range adjustment member 72 in the first orientation (see FIG. 4) within the receiver 70 at the upper end 24 of the riser 22 results in the pivot axis 59 being in the first position which is upwardly and rearwardly offset from the second position of the pivot axis 59 which results when the draw weight range adjustment member 72 placed in the second orientation (see FIG. 5) within the receiver 70 at the upper end 24 of the riser 22. Also, placing the draw weight adjustment member 72 in the first orientation (see FIG. 4) within the receiver 70 at the lower end 26 of the riser 22 results in the pivot axis 59 being in the first position which is downwardly and rearwardly offset from the second position of the pivot axis 59 which results when the draw weight range adjustment member 72 is in the second orientation (see FIG. 5) within the receiver 70 at the lower end 26 of the riser 22. In the depicted example, switching the draw weight range adjustment members 72 between the first and second orientations does not meaningfully change a draw length of the bow for a given setting of the limb bolts, but does change the draw weight. In one example, the change in draw length is less than or equal to 1/32 inch. In another example, there is no change in draw length.

Figure 13:
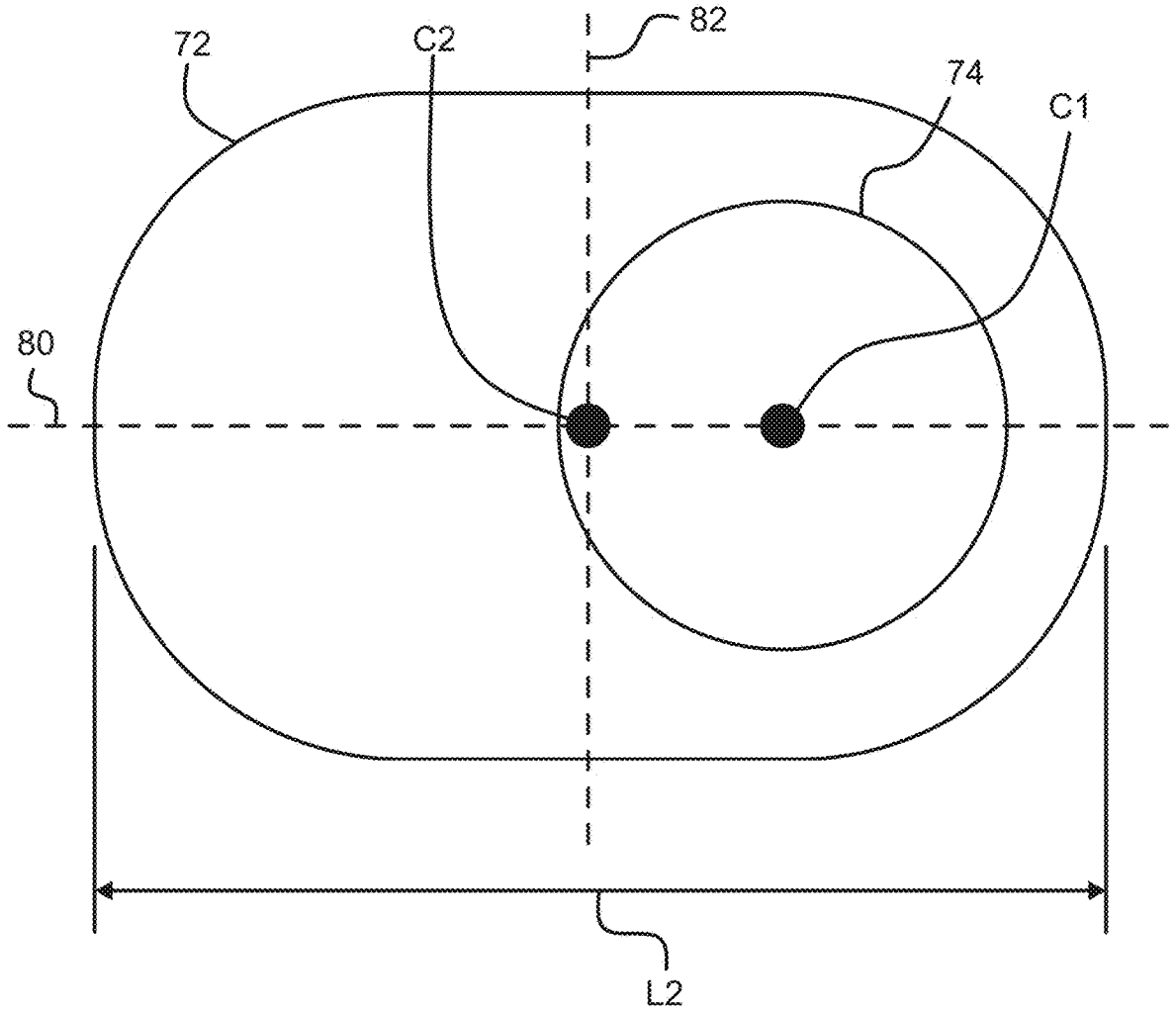
FIG. 13 is a side view of one of the draw weight adjustment members of the compound bow of FIG. 1.

Referring to FIG. 13, the draw weight range adjustment members 72 are each elongate along a length L2 and include major axes 80 that extend along the lengths L2 and minor axes 82 that are perpendicular with respect to the major axes 80. The pivot axle openings 74 are eccentrically positioned within the draw weight range adjustment members 72 such that centers C1 of the pivot axial openings 74 are offset from centers C2 of the draw weight range adjustment members 72 in orientations along the major axes 80 of the draw weight range adjustment members 72. For the depicted example, the first and second orientations of the draw weight range adjustment members 72 are flipped 180 degrees with respect to each other within the receivers 70 (see FIGS. 4 and 5). The pivot axle openings 74 are fully inside the receivers 70 when the draw weight range adjustment members 72 are in the second orientations (see FIG. 5) within the receivers 70 and the pivot axle openings 74 are at least partially outside the receivers 70 when the draw weight adjustment members 72 are in the first orientations (see FIG. 4) within the receivers 70. The draw weight range adjustment members 72 are depicted having rounded ends.

When the draw weight range adjustment members 72 are positioned in the receivers 70 the major axes 80 of the draw weight range adjustment members 72 extend rearwardly as the major axes 80 extend from the draw weight adjustment members 72 in a direction away from a sight line 84 of the bow.

Referring again to FIGS. 4 and 5, the receiver 70 at the upper end 24 of the riser 22 has an open end 73 that faces upwardly and rearwardly, and the receiver 70 at the lower end 26 of the riser 22 has an open end 73 that faces downwardly and rearwardly. The receivers 70 define slot axes 75 that align with the major axes 80 of the draw weight adjustment members 72 when the draw weight adjustment members 72 are installed in the receivers 70. The slot axes 75 extend rearwardly as the slot axes 75 extend from the receivers 70 in a direction away from the sight line 84.

Figure 8:
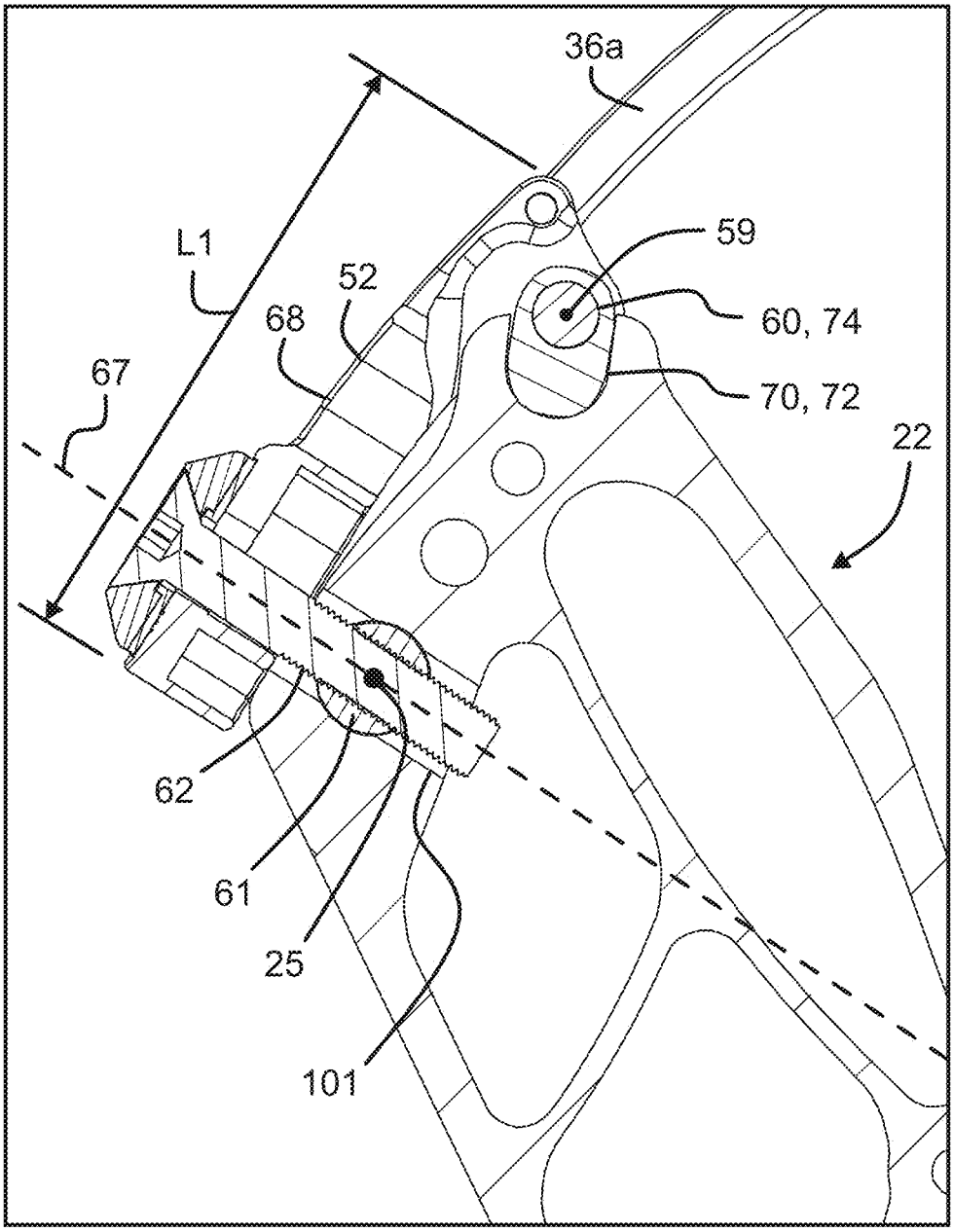
FIG. 8 is a cross-sectional view taken along section line 8-8 of FIG. 1 showing the limb pocket in a first draw weight position relative to the riser.
Figure 9:
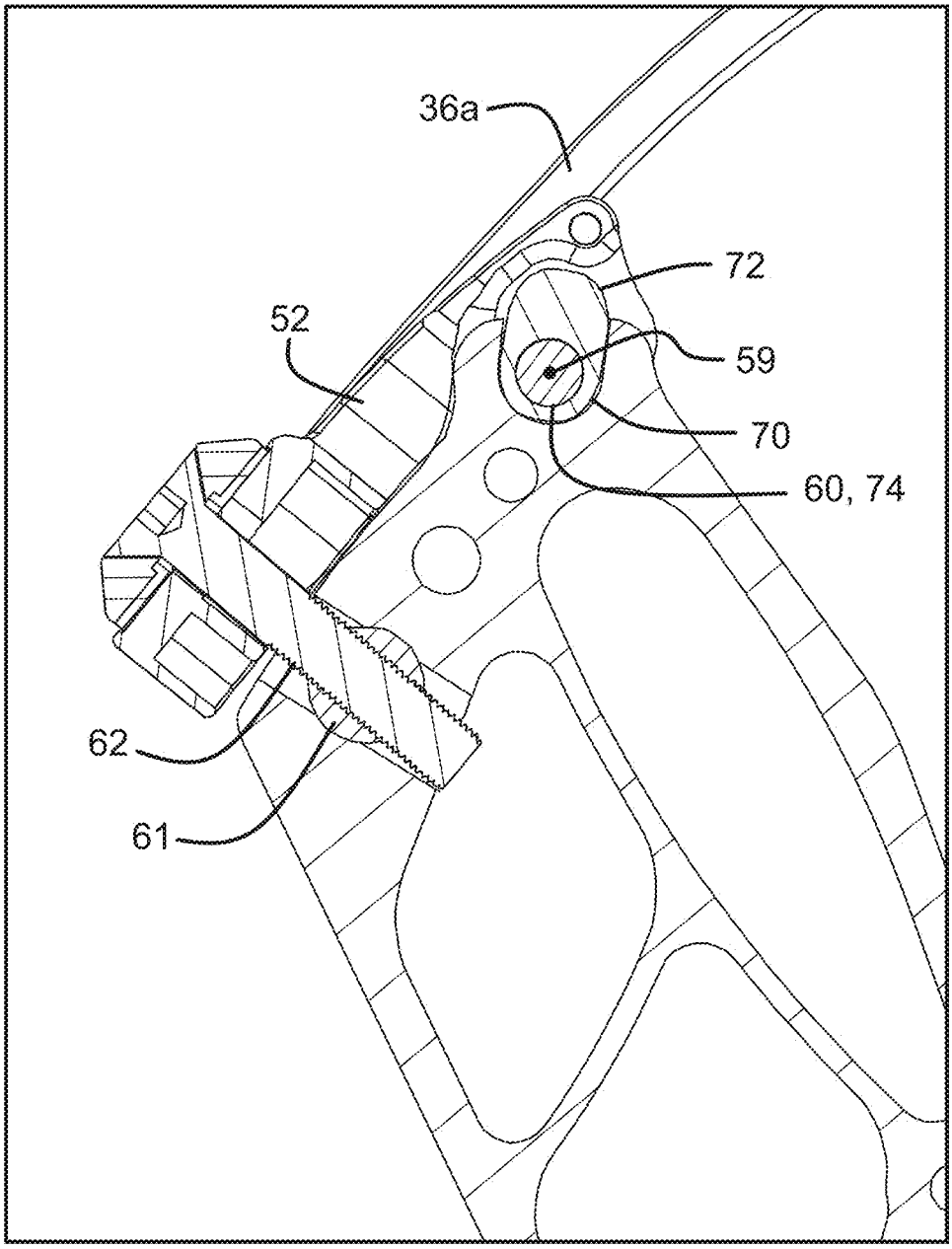
FIG. 9 is a cross-sectional view taken along section line 8-8 of FIG. 1 showing the limb pocket in a second draw weight position relative to the riser.

Referring to FIGS. 8 and 9, the limb pockets 52 are each mountable to the riser 22 in a first draw weight position (see FIG. 8) and a second draw weight position (see FIG. 9). The riser 22 can have first and second flats adjacent the limb bolts that are angled relative to one another. The limb pockets 52 can seat on the first flats when in the first draw weight position and can seat on the second flats when in the second draw weight position. The limb pockets 52 are pivoted relative to the riser (e.g., pivoted about the pivot axes 59 relative to the riser 22) and translated relative to the riser 22 (e.g., the pivot axes 59 are themselves moved relative to the riser 22) when moved between the first and second draw weight positions. The bow 20 has a larger draw weight when the limb pockets 52 are in the first draw weight position of FIG. 8 as compared to when the limb pockets 52 are in the second draw weight position of FIG. 9 because the first draw weight position results in more flexure (e.g., more elastic bending) of the limbs than the second draw weight position. The elongation of the bolt openings 64 combined with the ability of the nuts 61 to pivot and the oversized nature of the openings 101 provides sufficient play between the limb bolts 62 and the riser 22 to accommodate the pivotal and translational movement of the limb pockets 52 relative to the riser while the limb pockets 52 remain coupled to the riser by the limb bolts 62. The pivotal and translational movement of the limb pockets is coordinated to provide the desired change in draw weight while concurrently minimizing change in draw length.

Figure 10:
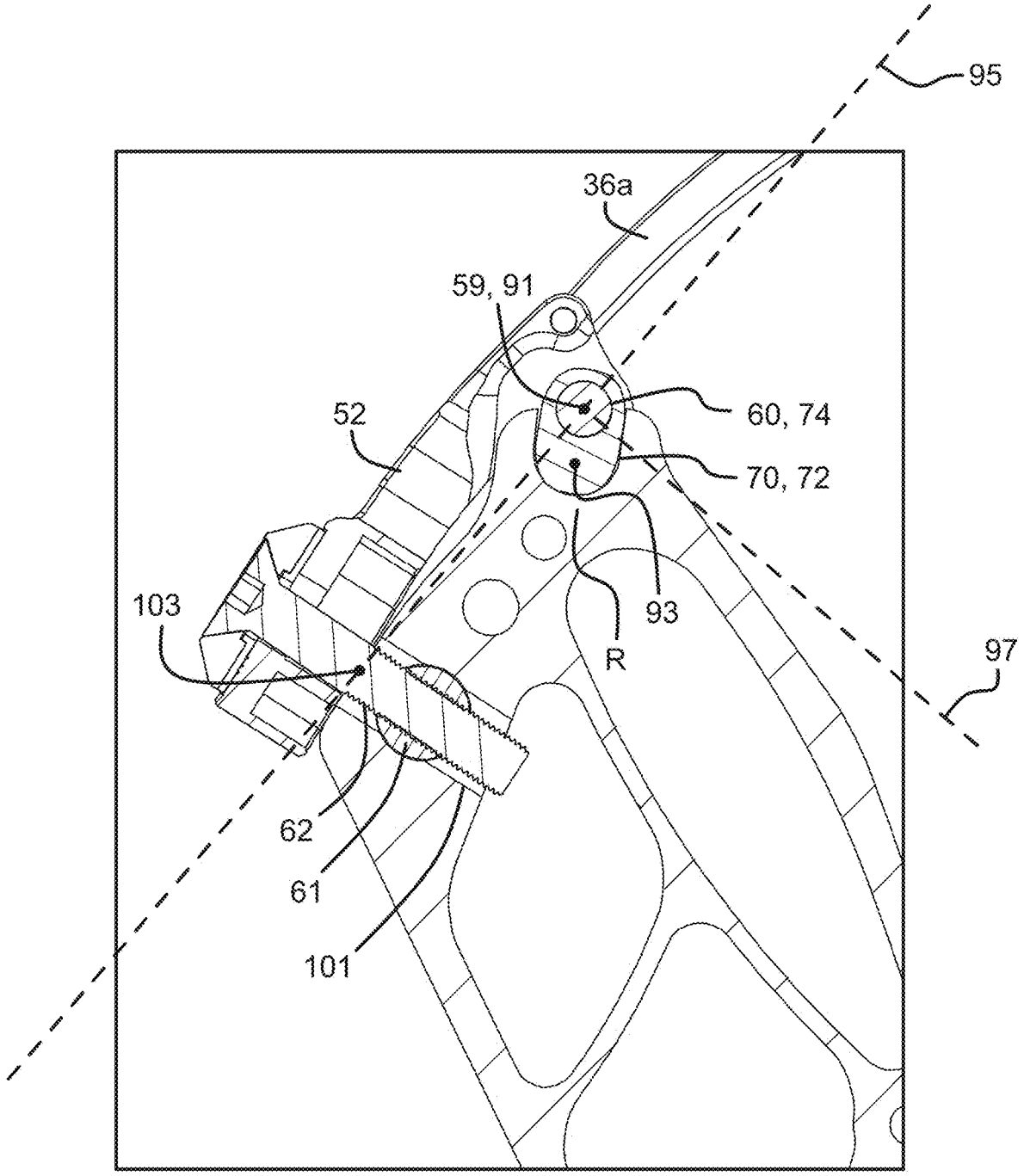
FIG. 10 is the cross-sectional view of FIG. 9 with reference lines added.

In designing a suitable relative positioning between the first and second pivot axis positions, the design process can start by determining the first pivot axis position (e.g., first pivot axis position 91 shown at FIG. 10) of the pivot axis 59. The first pivot axis position 91 is selected to provide the maximum draw weight and a desired draw length for the bow. The second pivot axis position (e.g., second pivot axis position 93 shown at FIG. 10) is then derived from the first pivot axis position by determining spacing from the first pivot axis that provides a desired reduction in draw weight while maintaining the same draw length. Referring to FIG. 10, the location of the second pivot axis position 93 will be in a region R of the riser 22 defined in part by a reference line 95 that intersects the first pivot axis position 91 and also intersects a center line of the limb bolt opening 101 at a reference point 103 located at an end of the riser 22 (e.g., at an end of the limb bolt opening 101 that is furthest from the sight line 84). The region R of the riser 22 is also defined in part by a reference line 97 that is perpendicular to the reference line 95 and that intersects the first pivot axis position 91. In certain examples, the second pivot axis position 93 is located closer to the sight line 84 (see FIG. 4) of the bow than the first pivot axis position 91.

The present disclosure also relates to a method for selecting between first and second draw weight ranges of a bow (e.g., bow 20). The first draw weight range corresponds to a pivot axis (e.g., pivot axis 59) of a limb attachment member (e.g., limb pocket 52) of the bow being in a first position relative to a riser (e.g., riser 22) of the bow. The second draw weight range corresponds to the pivot axis of the limb attachment member of the bow being in a second position relative to a riser of the bow. The second position is spaced from the first position (see FIGS. 4 and 5). The bow includes at least one draw weight adjustment member (e.g., draw weight adjustment member 72) defining a pivot axle opening (e.g., pivot axle opening 74) for receiving a pivot axle (e.g., axle 60) defining the pivot axis of the limb attachment member. The method includes selecting the draw weight adjustment member corresponding to a selected one of the first and second positions from a plurality of draw weight members for installation in a receiver of the riser; or selecting an orientation within the receiver of the draw weight adjustment member corresponding to the selected one of the first and second positions from a plurality of orientations of the draw weight adjustment member within the receiver.

Figure 14:
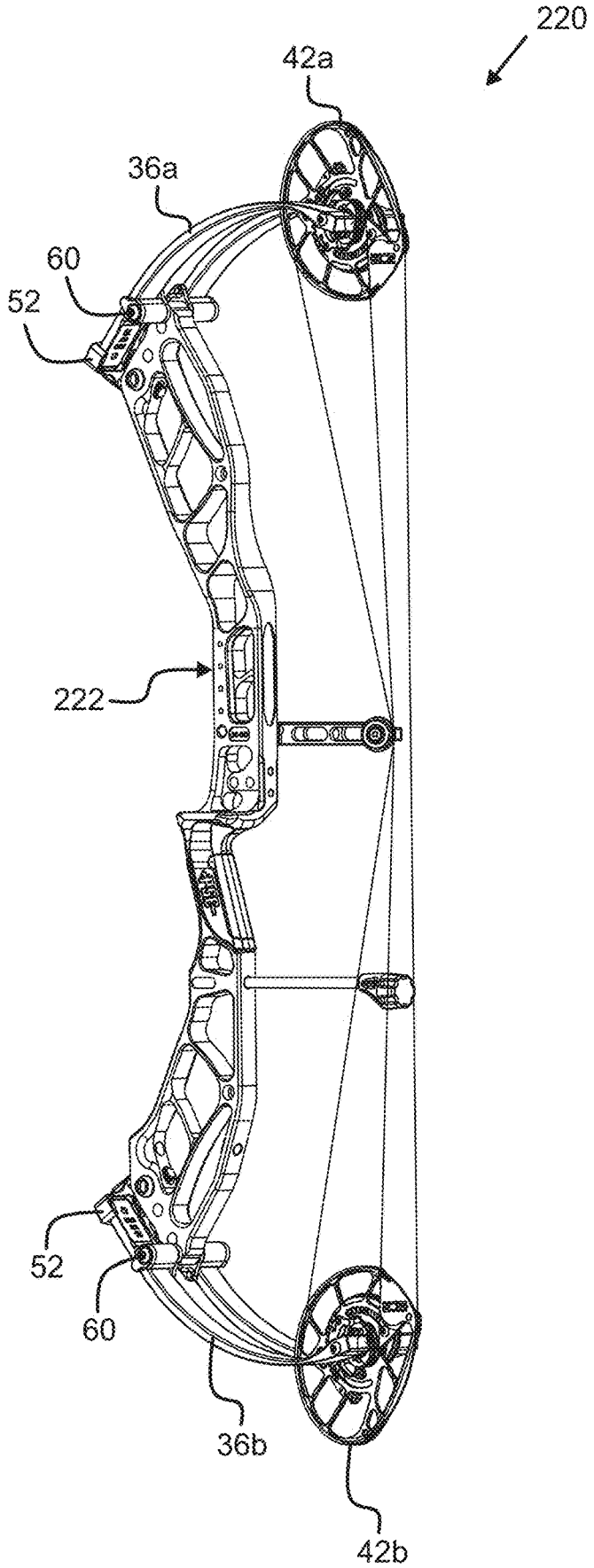
FIG. 14 is a rear, left side perspective view of another compound bow in accordance with the principles of the present disclosure.
Figure 15:
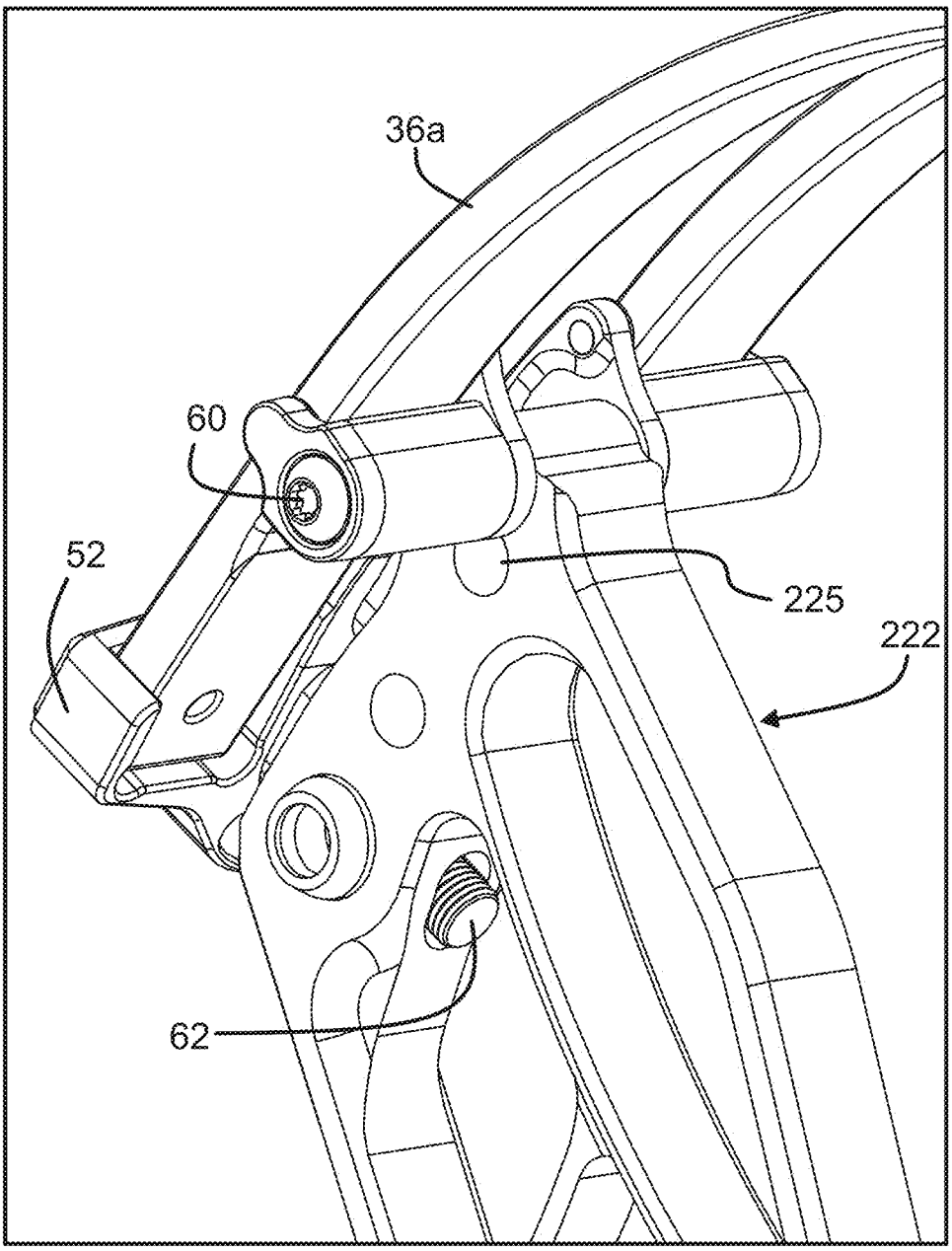
FIG. 15 is an enlarged view showing a limb pocket attaching limbs to the upper end of the riser of the compound bow of FIG. 14.
Figure 16:
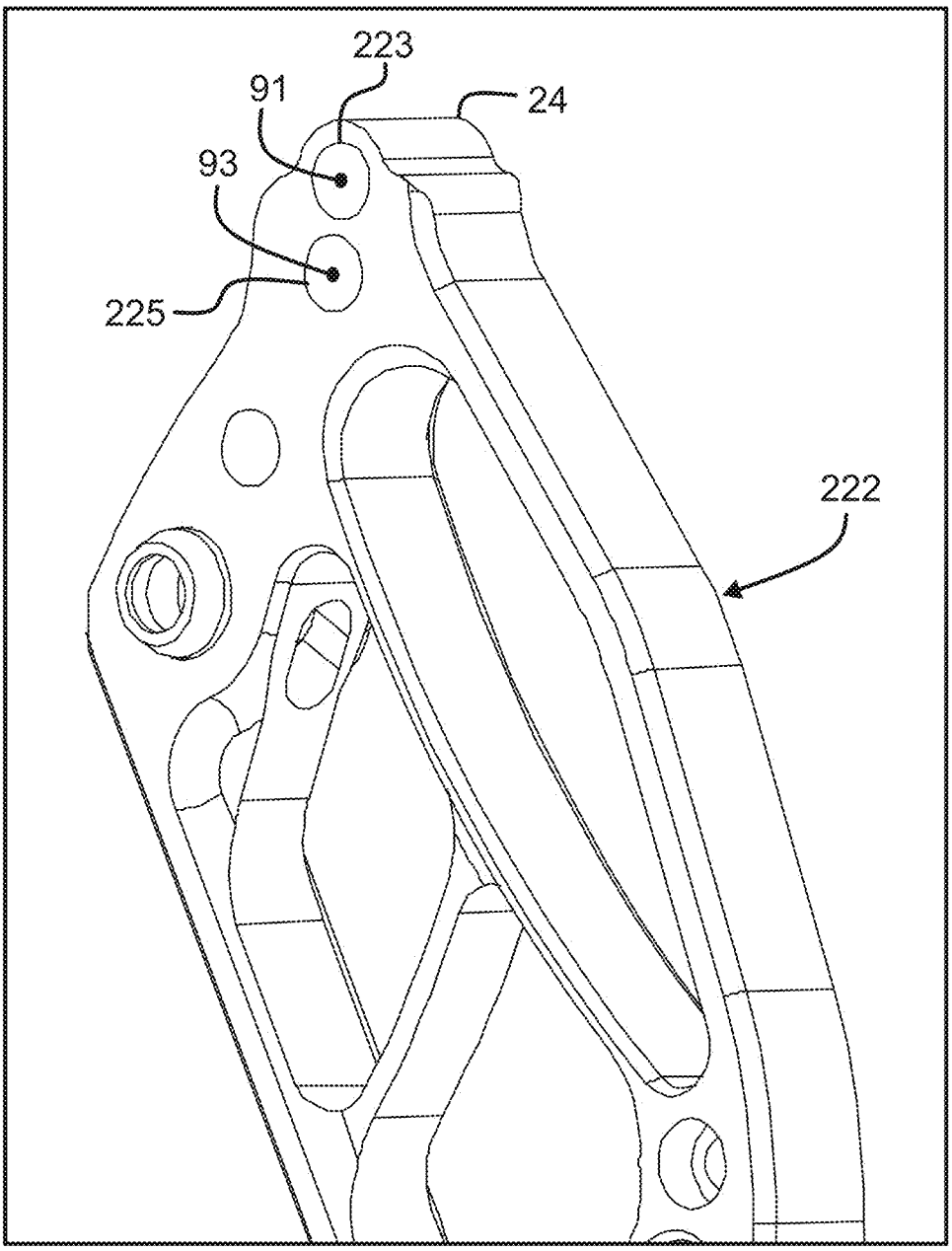
FIG. 16 is a perspective view of the upper end of the riser of the compound bow of FIG. 14.
Figure 17:
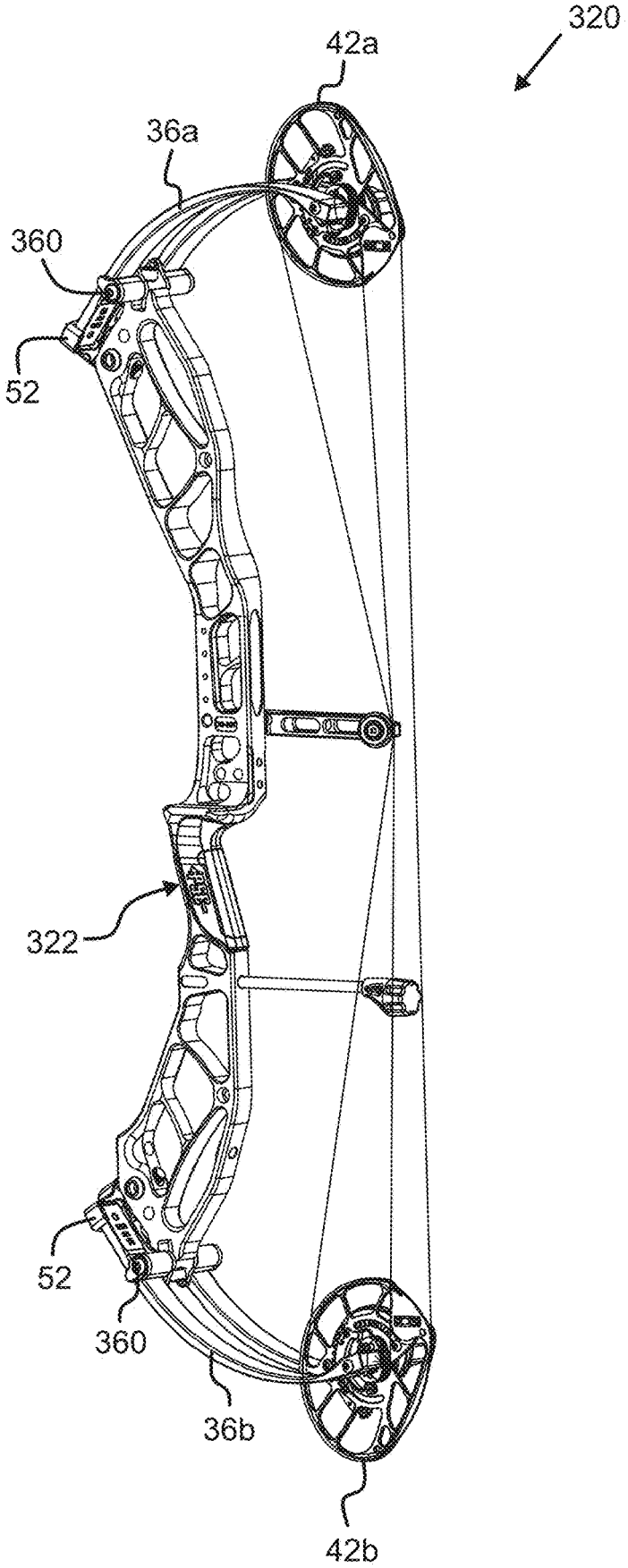
FIG. 17 is a rear, left side perspective view of another compound bow in accordance with the principles of the present disclosure.
Figure 18:
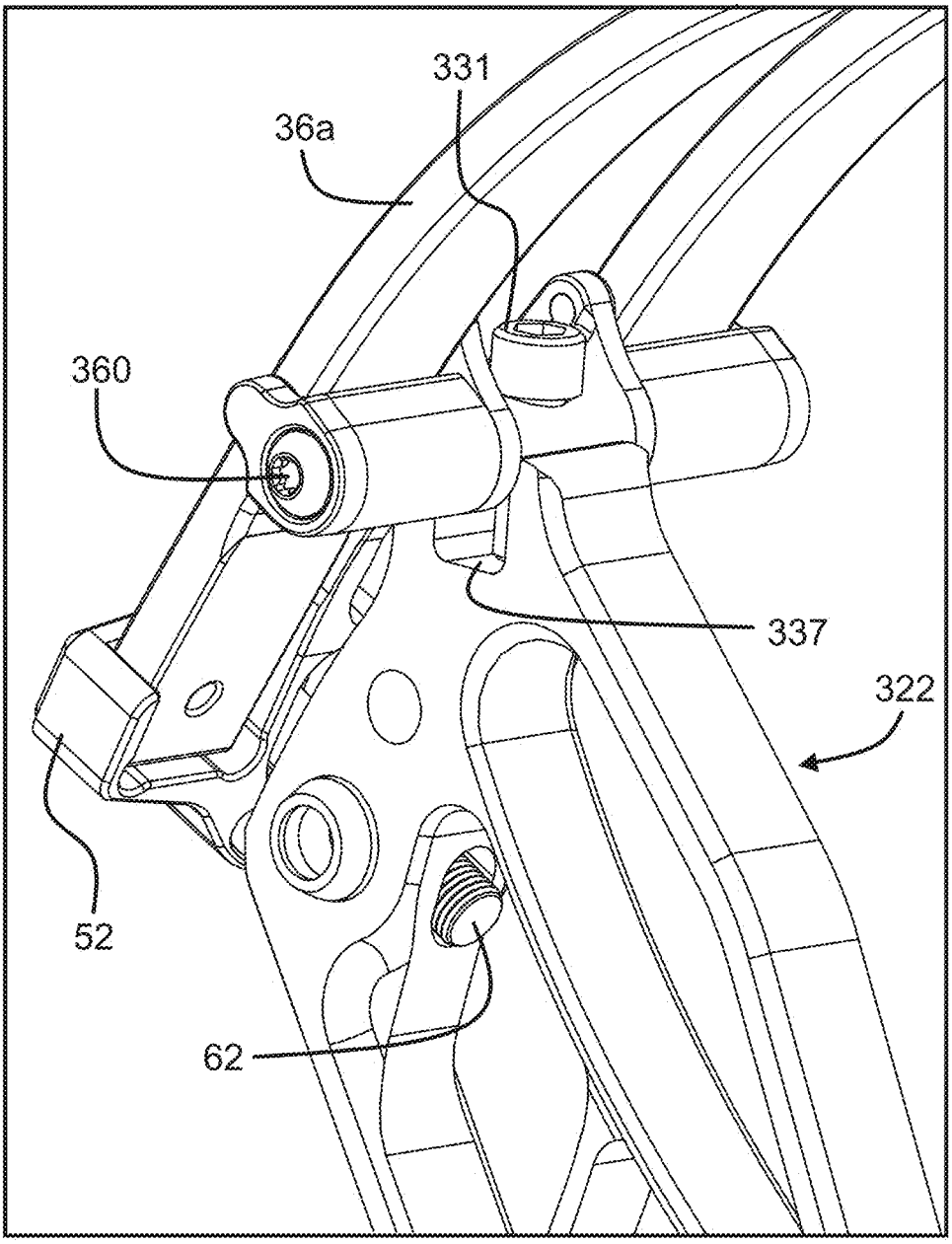
FIG. 18 is an enlarged view showing a limb pocket attaching limbs to the upper end of the riser of the compound bow of FIG. 17.
Figure 19:
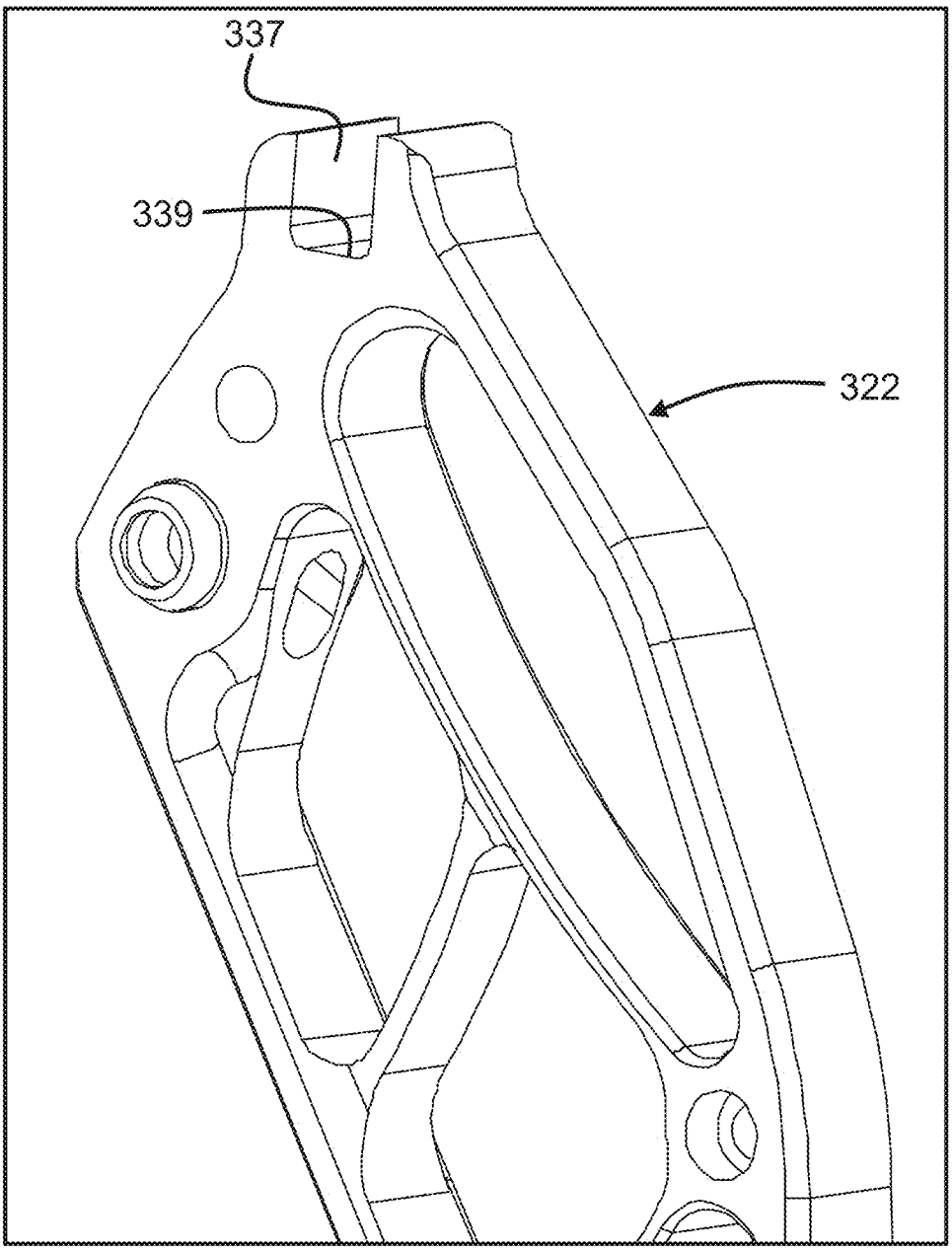
FIG. 19 is a perspective view of the upper end of the riser of the compound bow of FIG. 17.
Figure 20:
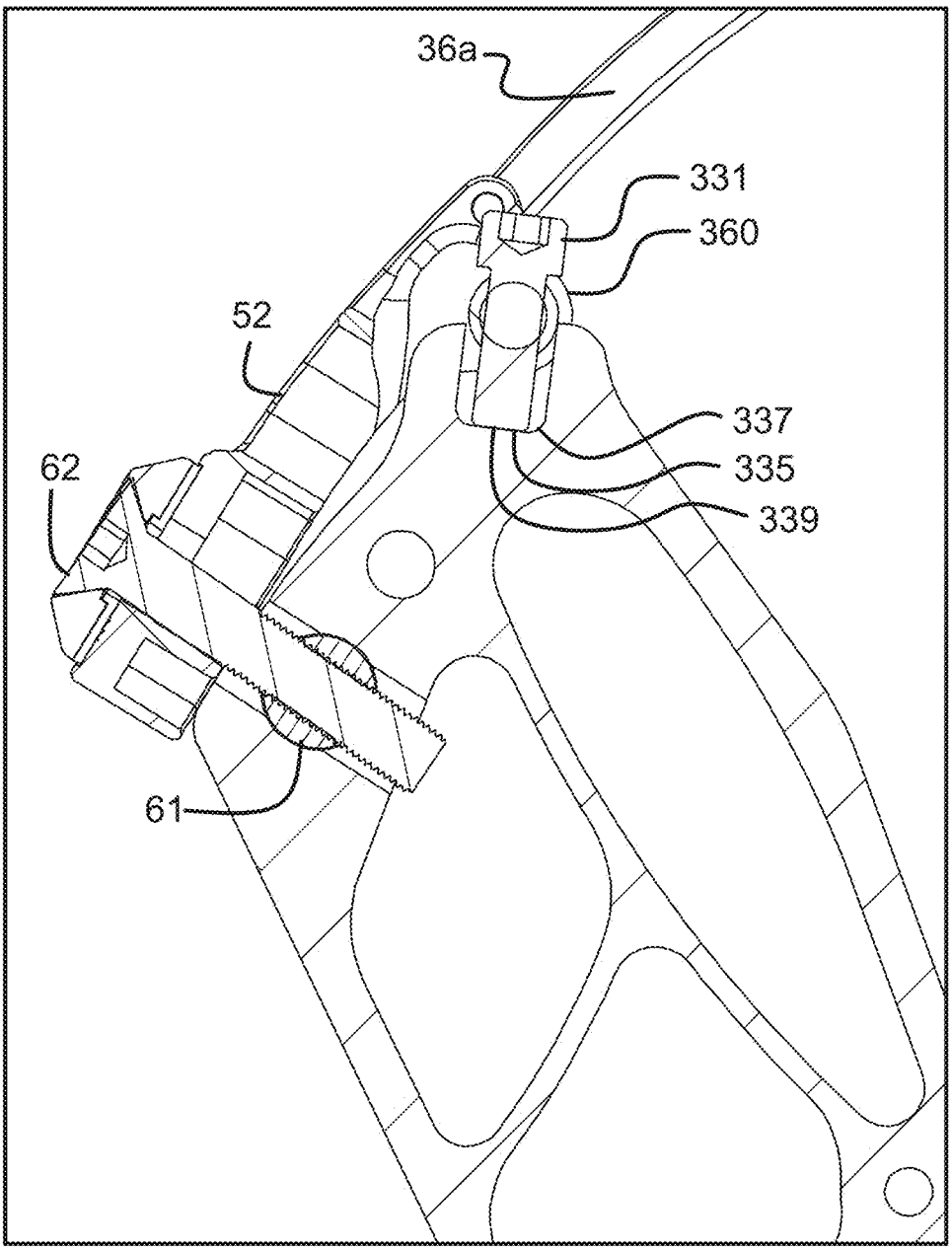
FIG. 20 is a cross-sectional view through the upper limb pocket and limb bolt of the compound bow of FIG. 17.
Figure 21:
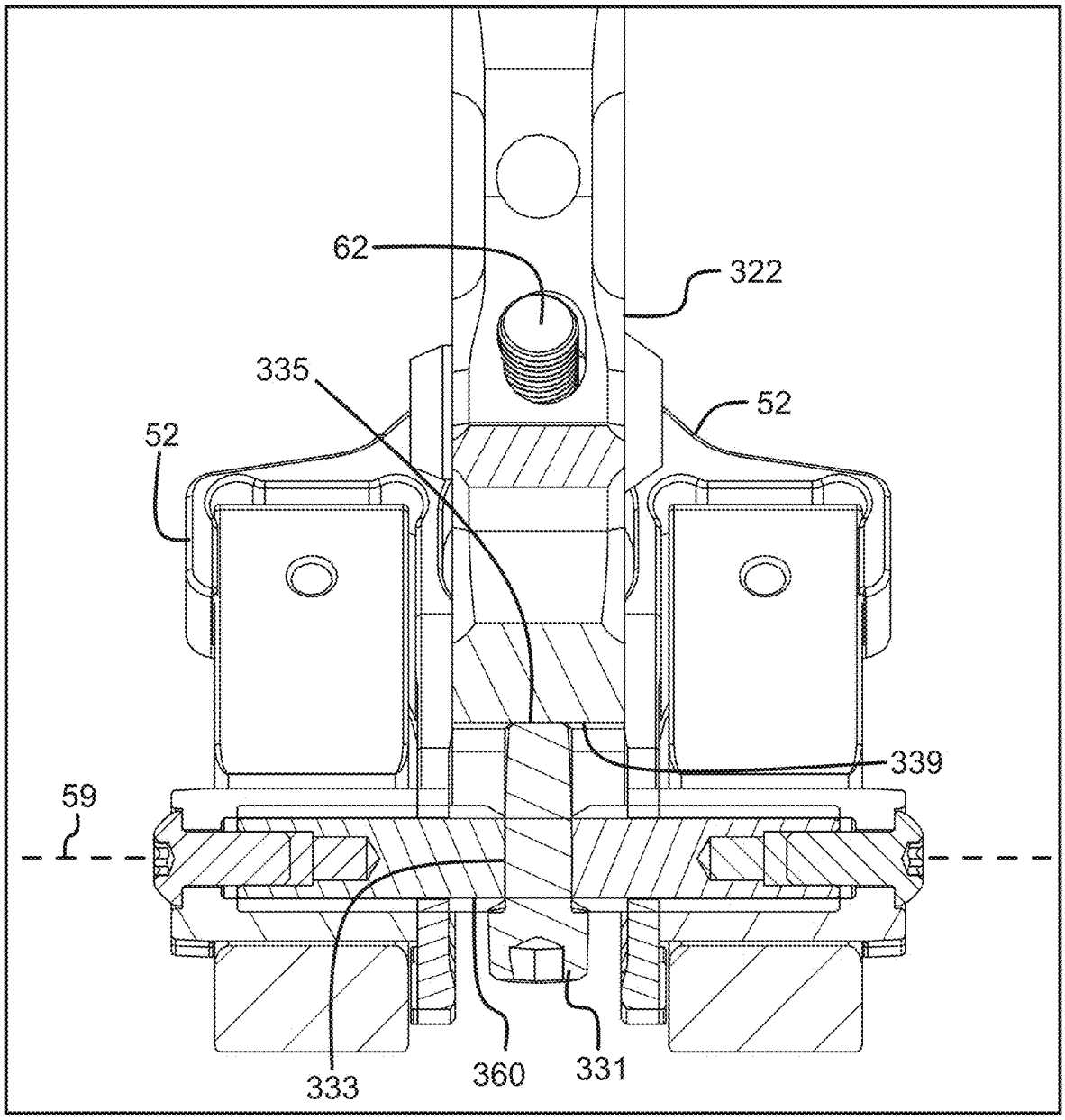
FIG. 21 is a cross-sectional view taken lengthwise through the pivot axle of the upper limb pocket of the compound bow of FIG. 17.

FIGS. 14-16 depict another compound bow 220 in accordance with the principles of the present disclosure having a configuration that allows for the selection between first and second draw weight ranges. Similar to the compound bow 20, the compound bow 220 includes a riser 222, limb pockets 52 attached to the riser 222 by pivot axles 60, limbs 36*a*, 36*b* attached to upper and lower ends of the riser 222 by the limb pockets 52, cams 42*a*, 42*b* supported by the limbs 36*a*, 36*b* and limb bolts 62 for providing a range of draw weights corresponding to different mounting locations of the pivot axles 60 within the riser 222. The limb pockets 52 are pivotally moveable relative to the riser 222 about laterally oriented pivot axes defined by the pivot axles 60. As shown at FIG. 16 for the upper end of the riser 222, the pivot axes are each positionable at a first pivot axis location 91 relative to the riser 222 and a second pivot axis location 93 relative to the riser 222. The first and second pivot axis locations 91, 93 are spaced-apart from each other. Similar first and second pivot axis locations are provided at the lower end of the riser 222. The riser 222 defines first and second pivot axle openings 223, 225 at each of the upper and lower ends of the riser 222 for receiving pivot axles 60 defining the pivot axes. The first pivot axle openings 223 correspond to the first pivot axis positions 91 at the upper and lower ends of the riser 222 and the second pivot axle openings 225 correspond to the second pivot axis positions 93 at the upper and lower ends of the riser 222. Similar to the bow 20, the limb bolts 62 are adapted for setting pivotal positions of the limb pockets 52 relative to the riser 222 about the pivot axes. When the pivot axes are at the first pivot axis locations 91 the limb bolts 62 can be used to adjust a draw weight of the bow 220 across a first range of draw weights. When the pivot axes are at the second pivot axis locations 93, the limb bolts 62 can be used to adjust the draw weight of the bow across a second range of draw weights different than (e.g., lower than) the first range of draw weights. The sets of first and second pivot axle openings 223, 225 allow the limb pockets 52 to be pivotally mounted to the riser 222 in a first draw weight position (similar to the first draw weight position of the limb pocket 52 of FIG. 8) and a second draw weight position (similar to the second draw weight position of the limb pocket 52 of FIG. 9).

FIGS. 17-21 depict another compound bow 320 in accordance with the principles of the present disclosure having a configuration that allows for the selection between different draw weight ranges that that can be achieved by adjustment of limb bolts. Similar to the compound bow 20, the compound bow 320 includes a riser 322, limb pockets 52 attached to the riser 322 by pivot axles 360, limbs 36*a*, 36*b* attached to upper and lower ends of the riser 322 by the limb pockets 52, cams 42*a*, 42*b* supported by the limbs 36*a*, 36*b* and limb bolts 62 for providing a range of draw weights corresponding to different mounting locations of the pivot axles 360 within the riser 222. The limb pockets 52 are pivotally moveable relative to the riser 322 about laterally oriented pivot axes defined by the pivot axles 360. The bow 320 includes threaded members 331 (e.g., bolts) at the upper and lower ends of the riser 322 that are rotated about their axes to move the pivot axes between a plurality of different pivot axis positions relative to the upper and lower ends of the riser 322. The various pivot axis locations that can be selected can be located along the lengths of the threaded members 331. The threaded members 331 are transversely oriented relative to the pivot axles 360 defining the pivot axes about which the limb pockets 52 pivot. The threaded members 331 threadingly engage the pivot axles 360 (e.g., the threaded members 331 have external threads that engage with internal threads defined within openings 333 defined transversely through the pivot axles 360). Thus, the threaded members 331 extend transversely through the pivot axles 360 and the pivot axles 360 ride on the threaded members 331. The threaded members 331 have ends 335 that bottom out within receivers 337 defined by the upper and lower ends of the riser 322. The receivers 337 have stop surfaces 339 that are engaged by the ends 335. The threaded members 331 are forced into the receivers 337 by the flexed nature the limbs 36*a*, 36*b*. By rotating the threaded members 331 in a first direction about their axes, the pivot axles 360 are driven outwardly away from the riser 322 to increase the draw weight of the bow 320. By rotating the threaded members 331 in a second direction about their axes, the pivot axles 360 are moved inwardly toward the riser 322 to decrease the draw weight of the bow 320. Since the pivot axles 360 define the pivot axes about which the limb pockets 52 pivot relative to the riser 322, by rotating the threaded members 331 about their axes the positions of the pivot axes 59 defined by the pivot axle 360 can be adjusted relative to the riser 322 to provide different draw weight positions for the limb pockets 52. At each location at which the pivot axes can be set by the threaded members 331 (which can include an infinite number of locations), the limb bolts 62 can provide a different range of draw weights. It will be appreciated that the maximum draw weight provided by each range of draw weights increases as the pivot axles 360 are moved outwardly away from the riser 322 by the threaded members 331.

It should be appreciated the above description is not meant to be limiting. The above description relates to several embodiments of the invention. Many other embodiments are possible.

We claim:

1. A bow comprising:

a riser having an upper end and a lower end, the riser also including a front side and rear side, the riser further including a left side and a right side;

upper and lower limbs respectively secured to the upper and lower ends of the riser;

cams for engaging a bow string, the cams being mounted to the upper and lower limbs; and limb attachment members for attaching the upper and lower limbs to the riser, the limb attachment members each being mountable to the riser in a first draw weight position and a second draw weight position, wherein the limb attachment members are pivoted and translated relative to the riser when moved between the first and second draw weight positions, and wherein the bow has a larger draw weight when the limb attachment members are in the first draw weight position as compared to when the limb attachment members are in the second draw weight position.

2. The bow of claim 1, wherein movement of the limb attachment members between the first and second draw weight positions does not vary a draw length of the bow by more than 1/32 of an inch.

3. The bow of claim 1, wherein movement of the limb attachment members between the first and second draw weight positions does not vary a draw length of the bow.

4. The bow of claim 1, further comprising:

laterally oriented pivot axles for allowing pivotal movement of the limb attachment members relative to the riser when the limb attachment members are mounted at each of the first and second draw weight positions;

limb bolts for setting pivotal positions of the limb attachment members relative to the riser about pivot axes defined by the pivot axles to allow the draw weight of the bow to be adjusted across a first range of draw weights corresponding to the first draw weight positions and a second range of draw weights corresponding to the second draw weight positions;

wherein the pivot axles are mounted at first pivot axle positions relative to the riser when the limb attachment members are at the first draw weight position relative to the riser, wherein the pivot axles are mounted at second pivot axle positions relative to the riser when the limb attachment members are at the second draw weight position relative to the riser, and wherein the first and second pivot axle positions are offset from each other.

5. The bow of claim 4, wherein the riser defines first and second pivot axle openings at each of the upper and lower ends of the riser for receiving the pivot axles, wherein the first pivot axle openings correspond to the first pivot axle positions and the second pivot axle openings correspond to the second pivot axle positions.

6. The bow of claim 4, wherein the upper and lower ends of the riser define receivers, wherein the bow includes draw weight range adjustment members that mount in the receivers, wherein the draw weight range adjustment members define pivot axle openings for receiving the pivot axles, and wherein the draw weight range adjustment members are configured to allow the pivot axle openings to be moved relative to the riser between first pivot axle opening positions corresponding to the first pivot axle positions and second pivot axle opening positions corresponding to the second pivot axle positions.

7. The bow of claim 6, wherein the draw weight range adjustment members are each elongate along a length and include major axes that extend along the lengths and minor axes that are perpendicular with respect to the major axes, and wherein the pivot axle openings are eccentrically positioned within the draw weight range adjustment members such that centers of the pivot axial openings are offset from centers of the draw weight range adjustment members in orientations along the major axes of the draw weight range adjustment members, wherein the draw weight range adjustment members are mountable in first and second orientations within the receivers, wherein the pivot axle openings are each at the first pivot axle opening position relative to the riser when the draw weight range adjustment members are each mounted in the first orientation within the receivers, and wherein the pivot axle openings are each at the second pivot axle opening position relative to the riser when the draw weight range adjustment members are each mounted in the second orientation within the receivers.

8. The bow of claim 7, wherein the major axes of the draw weight range adjustment members extend rearwardly as the major axes extend away from a sight line of the bow.

9. The bow of claim 7, wherein the receivers are open-ended slots, wherein the receiver at the upper end of the riser has an open end that faces upwardly and rearwardly, and wherein the receiver at the lower end of the riser has an open end that faces downwardly and rearwardly.

10. The bow of claim 7, wherein the pivot axle openings are fully inside the receivers when the draw weight range adjustment members are in the second orientations within the receivers and the pivot axle openings are at least partially outside the receivers when the draw weight adjustment members are in the first orientations within the receivers.

11. The bow of claim 10, wherein the draw weight range adjustment members have rounded ends.

12. The bow of claim 7, wherein the first and second orientations of the draw weight range adjustment members are flipped 180 degrees with respect to each other.

13. The bow of claim 4, wherein the first range of draw weights and the second range of draw weights partially overlap.

14. The bow of claim 4, wherein the bow includes threaded members that are rotated to move the pivot axles between the first and second pivot axle positions.

15. The bow of claim 14, wherein the threaded members are bolts that are transversely oriented relative to the pivot axles and that threadingly engage the pivot axles, the bolts having ends that bottom out within receivers defined by the upper and lower ends of the riser.

16. A bow comprising:

a riser having an upper end and a lower end, the riser also including a front side and rear side, the riser further including a left side and a right side;

upper and lower limbs respectively secured to the upper and lower ends of the riser;

cams for engaging a bow string, the cams being mounted to the upper and lower limbs;

pivotal limb attachment members for attaching the upper and lower limbs to the riser, the pivotal limb attachment members being pivotally moveable relative to the riser about laterally oriented pivot axes;

the pivot axes each being positionable at a first pivot axis location relative to the riser and a second pivot axis location relative to the riser, the first and second pivot axis locations for each pivot axis being spaced-apart from each other; and limb bolts for setting pivotal positions of the pivotal limb attachment members relative to the riser about the pivot axes, wherein when the pivot axes are at the first pivot axis locations the limb bolts can be used to adjust a draw weight of the bow across a first range of draw weights, and wherein when the pivot axes are at the second pivot axis locations the limb bolts can be used to adjust the draw weight of the bow across a second range of draw weights different than the first range of draw weights.

17. The bow of claim 16, wherein the riser defines first and second pivot axle openings at each of the upper and lower ends of the riser for receiving pivot axles defining the pivot axes, wherein the first pivot axle openings correspond to the first pivot axis locations and the second pivot axle openings correspond to the second pivot axis locations.

18. The bow of claim 16, wherein the upper and lower ends of the riser define receivers, wherein the bow includes draw weight range adjustment members that mount in the receivers, wherein the draw weight range adjustment members define pivot axle openings for receiving pivot axles defining the pivot axes, and wherein the draw weight range adjustment members are configured to allow the pivot axle openings to be moved relative to the riser between first pivot axle opening positions corresponding to the first pivot axis positions and second pivot axle opening locations corresponding to the second pivot axis locations.

19. The bow of claim 18, wherein the draw weight range adjustment members are each elongate along a length and include major axes that extend along the lengths and minor axes that are perpendicular with respect to the major axes, and wherein the pivot axle openings are eccentrically positioned within the draw weight range adjustment members such that centers of the pivot axial openings are offset from centers of the draw weight range adjustment members in orientations along the major axes of the draw weight range adjustment members, wherein the draw weight range adjustment members are mountable in first and second orientations within the receivers, wherein the pivot axle openings are each at the first pivot axle opening position relative to the riser when the draw weight range adjustment members are each mounted in the first orientation within the receivers, and wherein the pivot axle openings are each at the second pivot axle opening position relative to the riser when the draw weight range adjustment members are each mounted in the second orientation within the receivers.

20. The bow of claim 19, wherein when the draw weight range adjustment members are positioned in the receivers the major axes of the draw weight range adjustment members extend rearwardly as the major axes extend away from a sight line of the bow.

21. The bow of claim 19, wherein the receivers are open-ended slots, wherein the receiver at the upper end of the riser has an open end that faces upwardly and rearwardly, and wherein the receiver at the lower end of the riser has an open end that faces downwardly and rearwardly.

22. The bow of claim 19, wherein the pivot axle openings are fully inside the receivers when the draw weight range adjustment members are in the second orientations within the receivers and the pivot axle openings are at least partially outside the receivers when the draw weight adjustment members are in the first orientations within the receivers.

23. The bow of claim 22, wherein the draw weight range adjustment members have rounded ends.

24. The bow of claim 19, wherein the first and second orientations of the draw weight range adjustment members are flipped 180 degrees with respect to each other.

25. The bow of claim 16, wherein the first range of draw weights range and the second range of draw weights partially overlap.

26. The bow of claim 16, wherein the bow includes threaded members that are rotated to move the pivot axes between the first and second pivot axis locations.

27. The bow of claim 26, wherein the threaded members are bolts that are transversely oriented relative to pivot axles that define the pivot axes, wherein the bolts threadingly engage the pivot axles, and wherein the bolts have ends that bottom out within receivers defined by the upper and lower ends of the riser.

28. A bow comprising:

a riser having an upper end and a lower end, the riser also including a front side and rear side, the riser further including a left side and a right side;

upper and lower limbs having base ends and free ends, the base ends of the upper limbs attaching to the upper end of the riser and the base ends of the lower limbs attaching to the lower end of the riser;

cams for engaging a bow string, the cams being mounted at the free ends of the upper and lower limbs;

limb pockets that mount to the upper and lower ends the riser for attaching the base ends of the upper and lower limbs to the riser;

laterally oriented pivot axles for allowing pivotal movement of the limb pockets relative to the riser to adjust a draw weight of the bow;

limb bolts for setting pivotal positions of the limb pockets relative to the riser about pivot axes defined by the pivot axles to set a draw weight of the bow;

the upper and lower ends of the riser defining receivers; and draw weight range adjustment members that mount in the receivers, the draw weight range adjustment members defining pivot axle openings for receiving the pivot axles, the draw weight range adjustment members being mountable in first and second orientations within the receivers, wherein the pivot axes are each at a first position relative to the riser when the draw weight range adjustment members are each mounted in the first orientation within the receivers, wherein the pivot axes are each at a second position relative to the riser when the draw weight range adjustment members are each mounted in the second orientation within the receivers and wherein the first and second positions are offset from each other such that when the draw weight range adjustment members are in the first orientation the limb bolts can be used to adjust the draw weight across a first range of draw weights, and when the draw weight range adjustment members are in the second orientation the limb bolts can be used to adjust the draw weight across a second range of draw weights different than the first range of draw weights.

29. The bow of claim 28, wherein the first and second ranges of draw weights partially overlap.

30. A method for selecting between first and second draw weight ranges of a bow, the first draw weight range corresponding to a pivot axis of a limb attachment member of the bow being in a first position relative to a riser of the bow, the second draw weight range corresponding to the pivot axis of the limb attachment member of the bow being in a second position relative to a riser of the bow, the second position being spaced from the first position, the bow including at least one draw weight adjustment member defining a pivot axle opening for receiving a pivot axle defining the pivot axis of the limb attachment member, the method comprising:

selecting the draw weight adjustment member corresponding to a selected one of the first and second positions from a plurality of draw weight members for installation in a receiver of the riser or selecting an orientation within the receiver of the draw weight adjustment member corresponding to the selected one of the first and second positions from a plurality of orientations of the draw weight adjustment member within the receiver.

* * * * *